US006047680A

United States Patent [19]

Shimura et al.

[11] Patent Number: 6,047,680

[45] Date of Patent: Apr. 11, 2000

[54] ELECTRONICALLY CONTROLLED THROTTLE APPARATUS FOR AN ENGINE

[75] Inventors: Takahiro Shimura, Hitachinaka; Yoshikatsu Hashimoto, Hitachioota; Shigeru Tokumoto, Hitachinaka; Yasuo Saito, Hitachinaka; Toshifumi Usui, Hitachinaka; Eisuke Wayama, Hitachinaka; Yoshinori Fukasaku, Hitachi, all of Japan

[73] Assignees: Hitachi, Ltd.; Hitachi Car Engineering Co., Ltd., both of Japan

[21] Appl. No.: 09/175,992

[22] Filed: Oct. 21, 1998

[30] Foreign Application Priority Data

Oct. 21, 1997 [JP] Japan ..... 9-288795
Apr. 28, 1998 [JP] Japan ..... 10-118165

[51] Int. Cl.[7] ..... F02D 9/00

[52] U.S. Cl. ..... 123/399; 123/336

[58] Field of Search ..... 123/399, 336, 123/361, 306, 595

[56] References Cited

U.S. PATENT DOCUMENTS

| | | | |
|---|---|---|---|
| 5,201,291 | 4/1993 | Katoh et al. | 123/399 |
| 5,265,572 | 11/1993 | Kadomukai et al. | 123/396 |
| 5,423,299 | 6/1995 | Kumagai | 123/399 |
| 5,429,087 | 7/1995 | Tsujimo et al. | 123/336 |
| 5,546,903 | 8/1996 | Satou et al. | 123/399 |
| 5,609,132 | 3/1997 | Minowa et al. | 123/306 |
| 5,845,677 | 12/1998 | Kim | 123/595 |

FOREIGN PATENT DOCUMENTS 1-315629 12/1989 Japan .

*Primary Examiner*—Thomas N. Moulis
*Assistant Examiner*—Mahmoud M. Gimie
*Attorney, Agent, or Firm*—Evenson, McKeown, Edwards & Lenahan P.L.L.C.

[57] ABSTRACT

To achieve an integration of components and the rationalization of the default opening mechanism of the throttle valve, a reduction of the load of the motor drive and a stabilization of the throttle control operation. In a default opening setting mechanism with which the default opening of the throttle valve 24 is maintained to be larger than the fully closed position when the electric current does not pass through the motor 12 driving the throttle shaft 18, the throttle lever 3 and the sleeve 45 are inserted and fixed, and the sleeve 42 united together with the return lever 2 is engaged with the sleeve 45 so as to be enabled to rotate in relative to the sleeve 45. The sleeve 42 is energized by the return coil in the close direction of the throttle valve 24 up to the initial opening position. This energized operation enables the return lever 2 to be coupled with the sleeve 3. A force for opening the valve for keeping the default opening the throttle valve 24 is energized by the spring 5 onto the throttle shaft 18 near the fully closed position.

8 Claims, 24 Drawing Sheets

| | θ1 | θ2 | θ3 |
|---|---|---|---|
| SET VALUE | 30° | 5° | 7° |
| | | | |

ELECTRONICALLY CONTROLLED THROTTLE APPARATUS FOR AN ENGINE

BACKGROUND OF THE INVENTION

The present invention relates to an electronically controlled throttle apparatus which opens and closes a throttle valve of the motor vehicle by a motor controlled electrically.

As is described in Japanese Patent Application Laid-Open 1-315629 (1989), in the conventional electronically controlled throttle apparatus, a single throttle valve mounted on a single bore is controlled to be made open and close by a DC motor. The motor and the throttle valve are placed so that their operation shafts may be parallel to each other and, they are coupled by a reduction gear at one end of each of their shafts. The extension of the throttle body in the direction of the air flow, that is, the height of the throttle body is about twice as much as the diameter of the motor, and the overall height of the throttle body in the axial direction is relatively high and the dead space between the motor and the throttle body is larger. This is because the height of the throttle body is required to be reserved when the throttle valve is fully opened and positioned to be parallel to the direction of the air flow.

SUMMARY OF THE INVENTION

An object of the present invention is to provide an electronically controlled throttle apparatus having less dead space and a simple shape by means of making the diameter of the motor and the extension of the throttle body in the height direction almost identical to each other.

As the rotational movement of the motor is transmitted to the throttle valve after it was reduced by the gears, metal powders generated by rubbing and wearing between gears may cause bad effects on the sensors.

Another object of the present invention is to provide an electronically controlled throttle apparatus in which the metal powder from the gear does not cause bad effects on the sensors.

Further, taking into consideration of the occurrence of a trouble in a circuit of the throttle control system or a motor, there are provided a so-called limp home mechanism or a default opening setting mechanism enabling the throttle apparatus to work with the accelerator pedal mechanically. It is, therefore, desired to integrate and rationalize the parts of their auxiliary mechanism.

Furthermore, it should be considered that the electronically controlled throttle apparatus is used under a severe temperature condition. Therefore, a further object of the present invention is to provide an apparatus in which a motor can be used under a good temperature condition for the best operational efficiency, and the throttle valve does not freeze even in a cold season.

In the electronically controlled throttle apparatus, a large output error in the sensor and an abnormal output signal from the sensor may lead to an erroneous control.

A further object of the present invention is to provide an apparatus in which the safety of the sensor can be secured.

Further, as the electronically controlled throttle apparatus is installed in the engine room, it is susceptible to vibration.

A further object of the present invention is to prevent a resonance in a operating condition.

While the reference position of the throttle valve (the default opening position) is adjusted by a screw (default screw), there is such a problem that the screw may re-adjust in a market.

A further object of the present invention is to prevent the re-adjustment of the screw after shipping the product to the market.

There is a possibility that the gas generated from silicone included in protection resin for protecting the circuit may cause the failure of the electric conduction in the sensor.

A further object of the present invention is quickly to discharge the generated gas outside.

There is a possibility that a short-circuit may be made between the terminals of the motor due to the metal powder generated by rubbing and wearing the brushes in the motor.

A further object of the present invention is to prevent a short-circuit from being made in the motor.

In the case that a throttle apparatus is used in an intake unit of an in-cylinder direct fuel-injection system, it is required to control an air flow rate with accuracy and with good response.

A further object of the present invention is to improve the response and the accuracy of control of the throttle valve.

In order to attain the above object in the present invention, an electronically controlled throttle apparatus is composed of a couple of bores, a single rotating shaft crossing the bores, a throttle valve rotated and supported for enabling the control of the opening area of the individual bore, a motor having a rotating shaft arranged to be parallel to the above single rotating shaft, and a gear mechanism placed between one end of the motor shaft and one end of the above single rotating shaft.

As a couple of bores are used, the amount of air obtained by a single bore can be controlled by a throttle valve having a half area. As a result, the diameter of the throttle valve can be reduced to be $1/\sqrt{2}$. Therefore, in the present invention in which a couple of bores is used, the extension of the throttle valve in the height direction at the full-opening position becomes $1/\sqrt{2}$, and hence, the height of the body can be reduced. Thus, as the diameter of the motor and the height of the throttle body can be made to be identical to be each other, the dead space around the throttle body can be reduced totally.

In a throttle apparatus for an engine comprising a deceleration gear mechanism and a motor for driving a throttle valve, and a throttle position sensor for detecting the position of opening of the throttle valve, the deceleration gear mechanism is arranged on one side of a throttle body and the throttle position sensor on the other side.

Because the gear mechanism and the throttle position sensor are placed apart between the throttle body, the rubbing and wearing metal powder is prevented from coming into the throttle position sensor and the degradation of the performance of the throttle position sensor is prevented.

Further, the throttle position sensor is provided in a space between the throttle body and the spring mechanism for energizing the throttle valve mounted at the end of the throttle shaft into a close direction or an open direction.

According this arrangement, the throttle position sensor can be covered with the spring mechanism, and it becomes possible to isolate the throttle position sensor from outside, without attaching a specific cover to the throttle position sensor itself.

According to another aspect of the present invention, in an electronically controlled throttle apparatus for an engine comprising a motor of a throttle control system, a fully closed position setting mechanism, and a default opening setting mechanism for keeping the default opening in the opening larger than that at the fully closed position during a non-exciting state of the motor, a gear mechanism of the motor for driving the throttle shaft is provided at one side of the throttle shaft, and at the other side, a case portion surrounding the end of the throttle shaft is formed in the throttle body. The throttle position sensor and the default opening setting mechanism are inserted into the case portion. In addition, an accelerator shaft working with the accelerator shaft is hold on the case portion, and the accelerator position sensor is provided on the accelerator shaft. A member for supporting the accelerator position sensor may be used as the cover for the case portion.

In addition to the default opening mechanism, the throttle position sensor used for controlling electrically the throttle position sensor can be integrated and placed in a single case part placed at the side wall of the throttle. Further, by using the supporting member of the accelerator shaft and the accelerator position sensor commonly as the cover of the case part, the parts to be used can be decreased in number.

There is provided a hot water channel for passing hot water through the throttle body . The hot water channel is provided in the neighborhood of the motor and/or the valve.

A completely independent plate is lapped on the bracket formed on the motor body and fixed on it by screws.

By screwing the motor bracket on between the motor body and the plate, the rigidity is improved when the motor is mounted on the body of the throttle apparat us, and thus the vibration at terminals of the motor is reduced. In addition, the resonance frequency is shifted to a higher frequency.

The throttle position sensor and/or accelerator position sensor is constructed in dual systems, in which one of the systems acts as an auxiliary system and/or a back-up system. Further, respective connectors are arranged separately in a vertical direction. As a result, the possibility of erroneous connection is reduced.

The screw for adjusting the default is installed in the case of the throttle body housing the default mechanism. As a result, the re-adjustment by users in a market is prevented.

Further, according to a further aspect of the present invention, a gas drainage for siliconee gas is provided in the gear box and/or the accelerator box. As a result, the formation of the oxide film and the failure of the conduction is prevented.

Further, because according to a further aspect of the present invention, the motor terminal is provided in the position higher than that of the shaft, the brush powder does not attach to the motor terminal. As a result, the trouble of the motor is reduced.

The motor is used, of which the rated torque is 0.049 N·m, and the normal speed is 2450 rpm. The motor speed is decelerated into 1/10.27 via the gear, and transmitted to the throttle shaft. By using such motor performance and gear ratio, it becomes possible to ensure the high response required for the throttle valve of the in-cylinder injection apparatus.

DETAILED DESCRIPTION OF THE PREFERRED EMBODIMENTS

Figure 1:
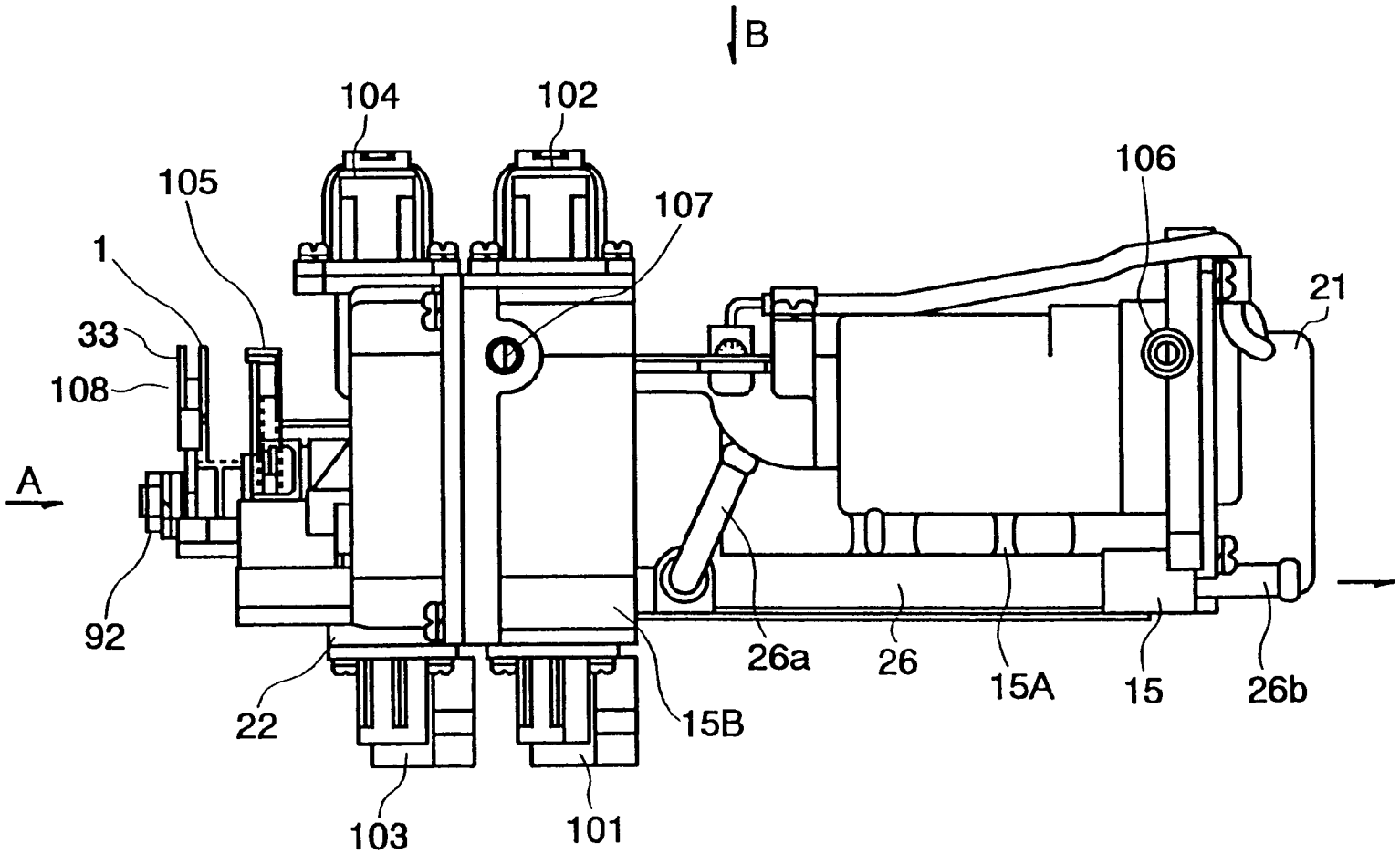
FIG. 1 is a view showing a first embodiment of the present invention.

Preferred embodiments of the present invention will be described by referring to the drawings.

Figure 2:
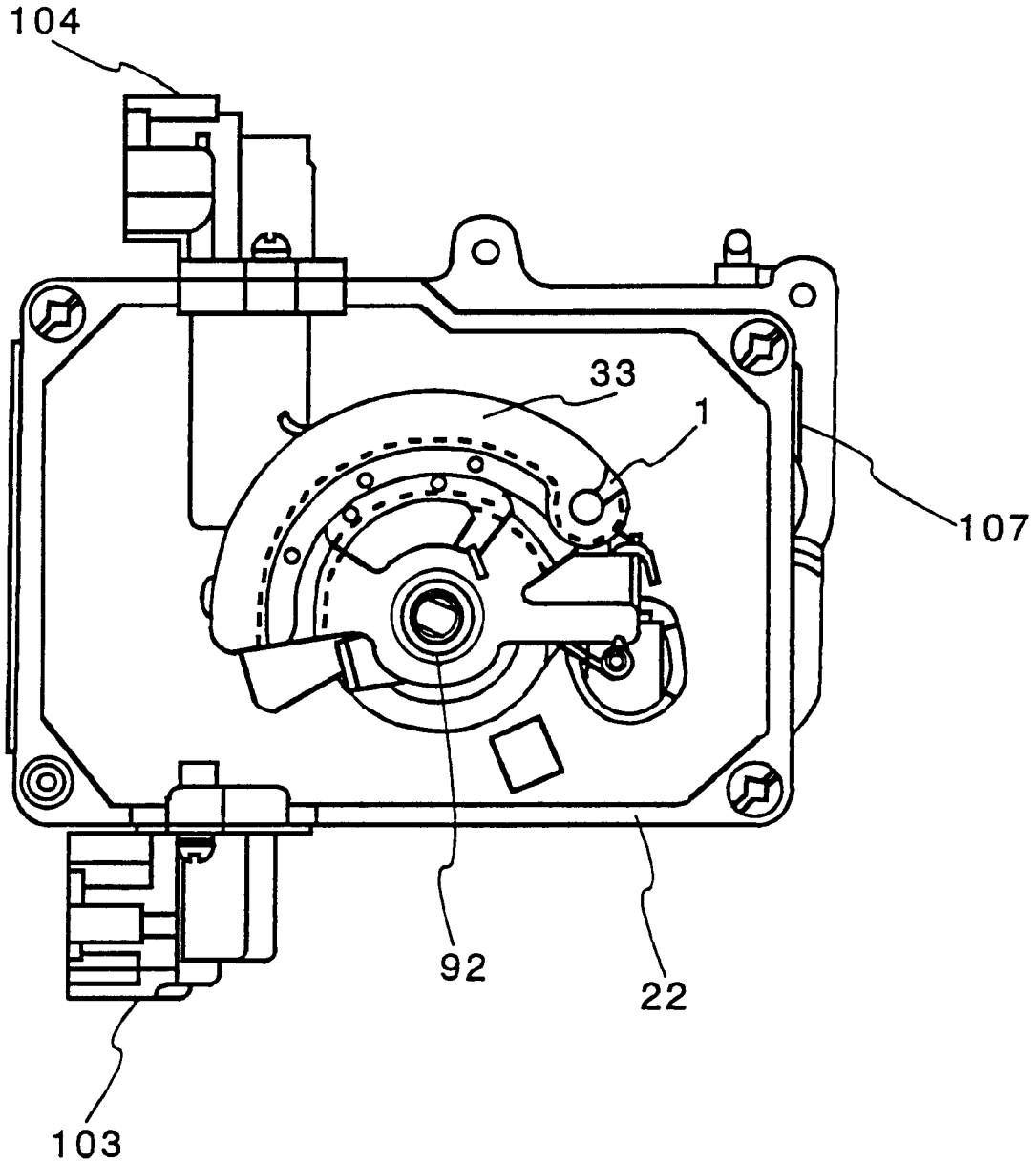
FIG. 2 is a view projected from a direction of A in FIG. 1.
Figure 3:
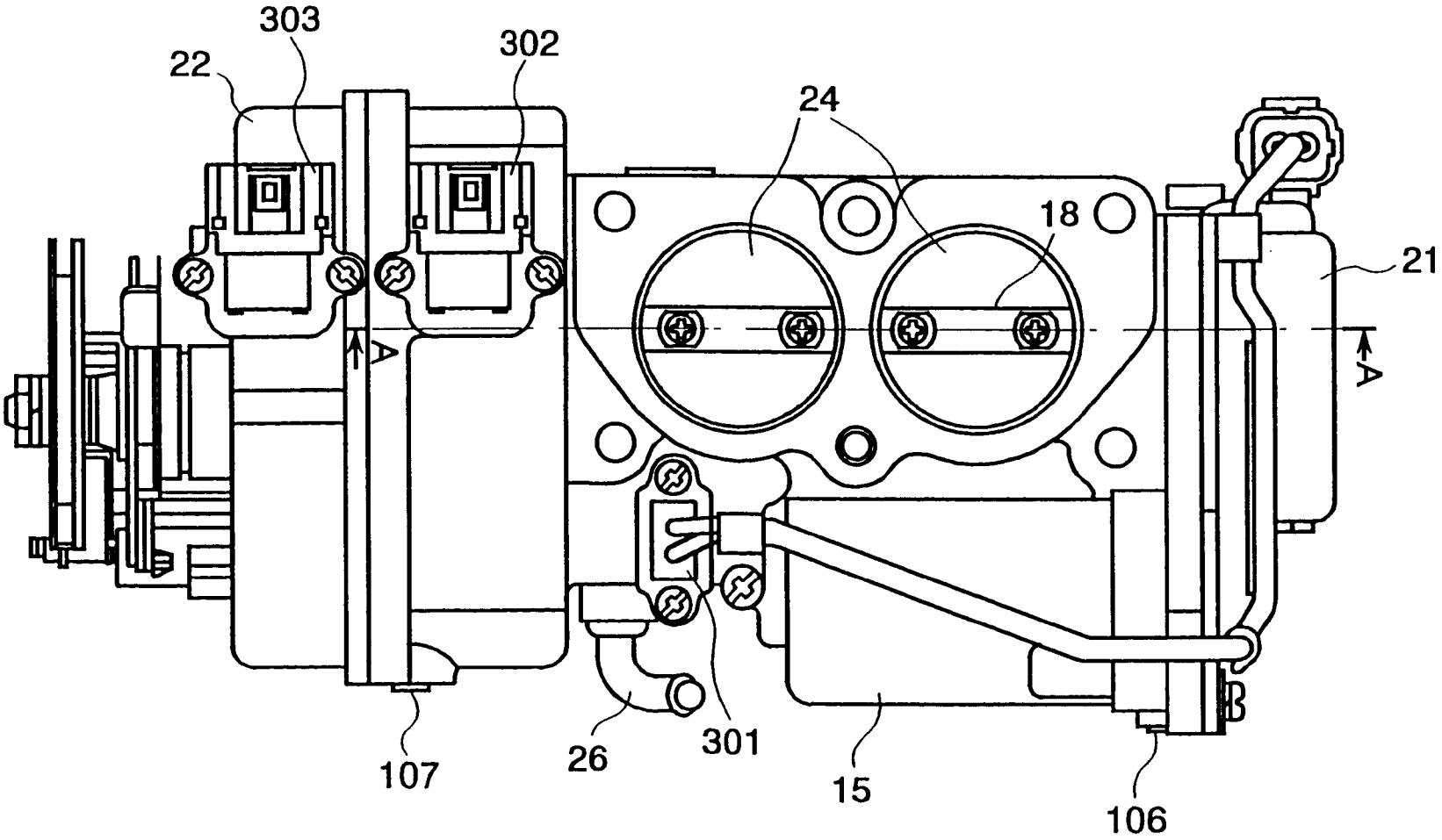
FIG. 3 is a view projected from a direction of B in FIG. 1.
Figure 4A:
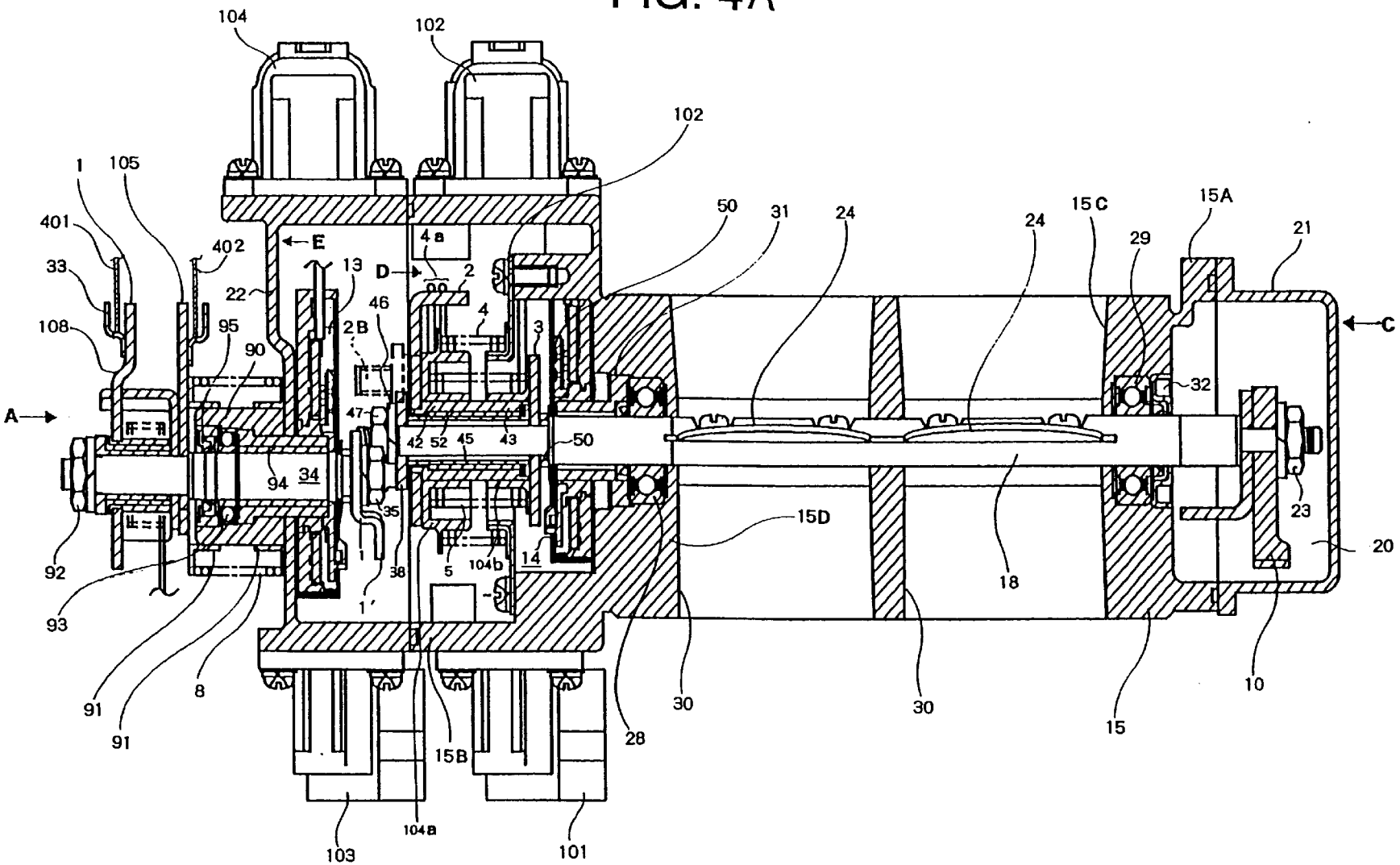
FIG. 4A is a cross-sectional view showing the first embodiment of the present invention.
Figure 4C:
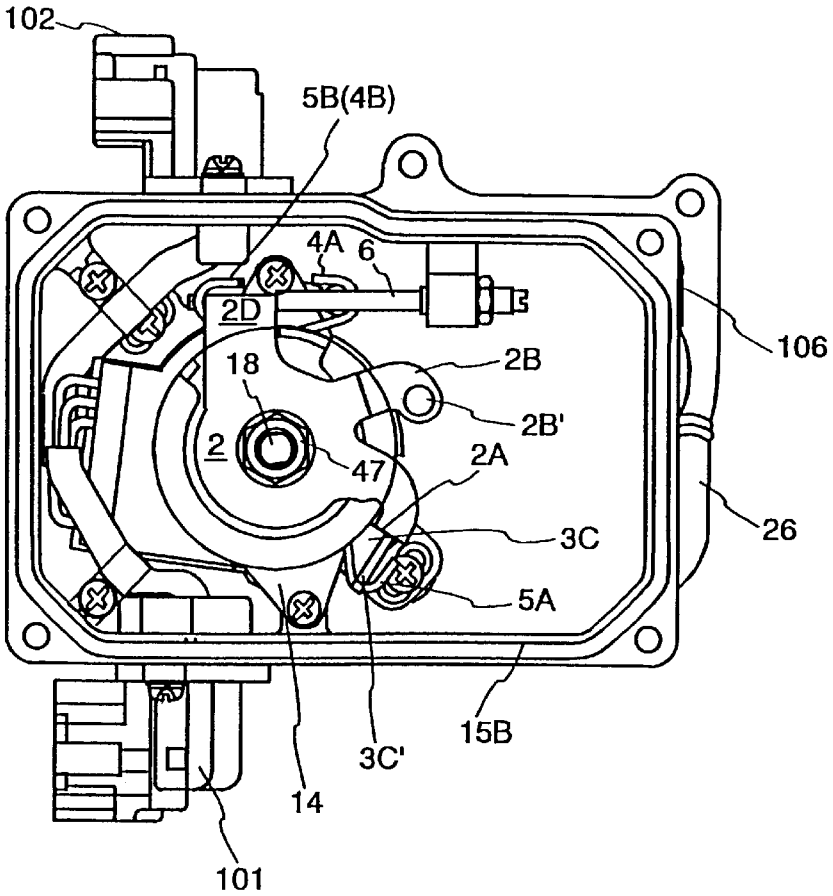
FIG. 4C is a view projected from a direction of D in FIG. 4A.
Figure 4B:
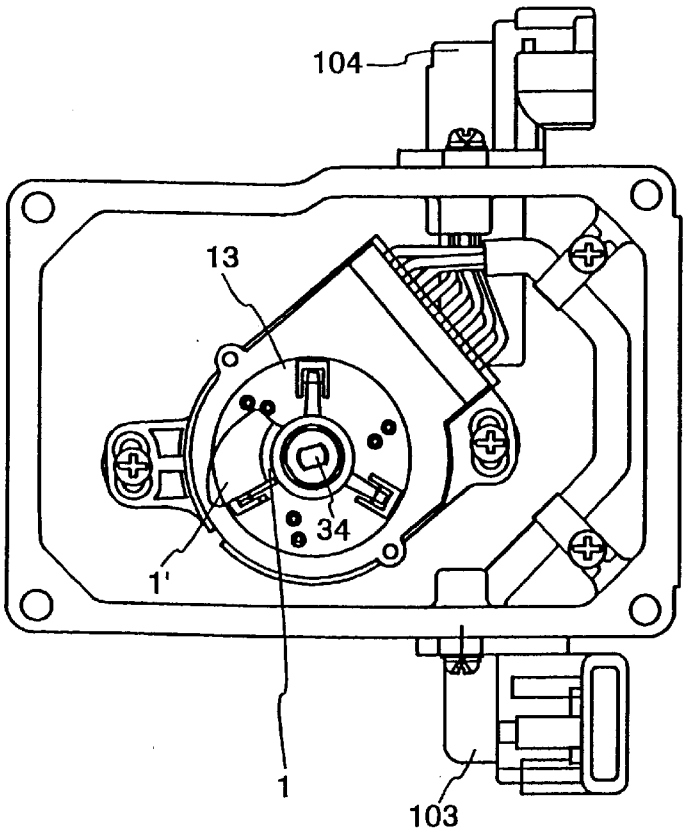
FIG. 4B is a view projected from a direction of E in FIG. 4A.
Figure 5:
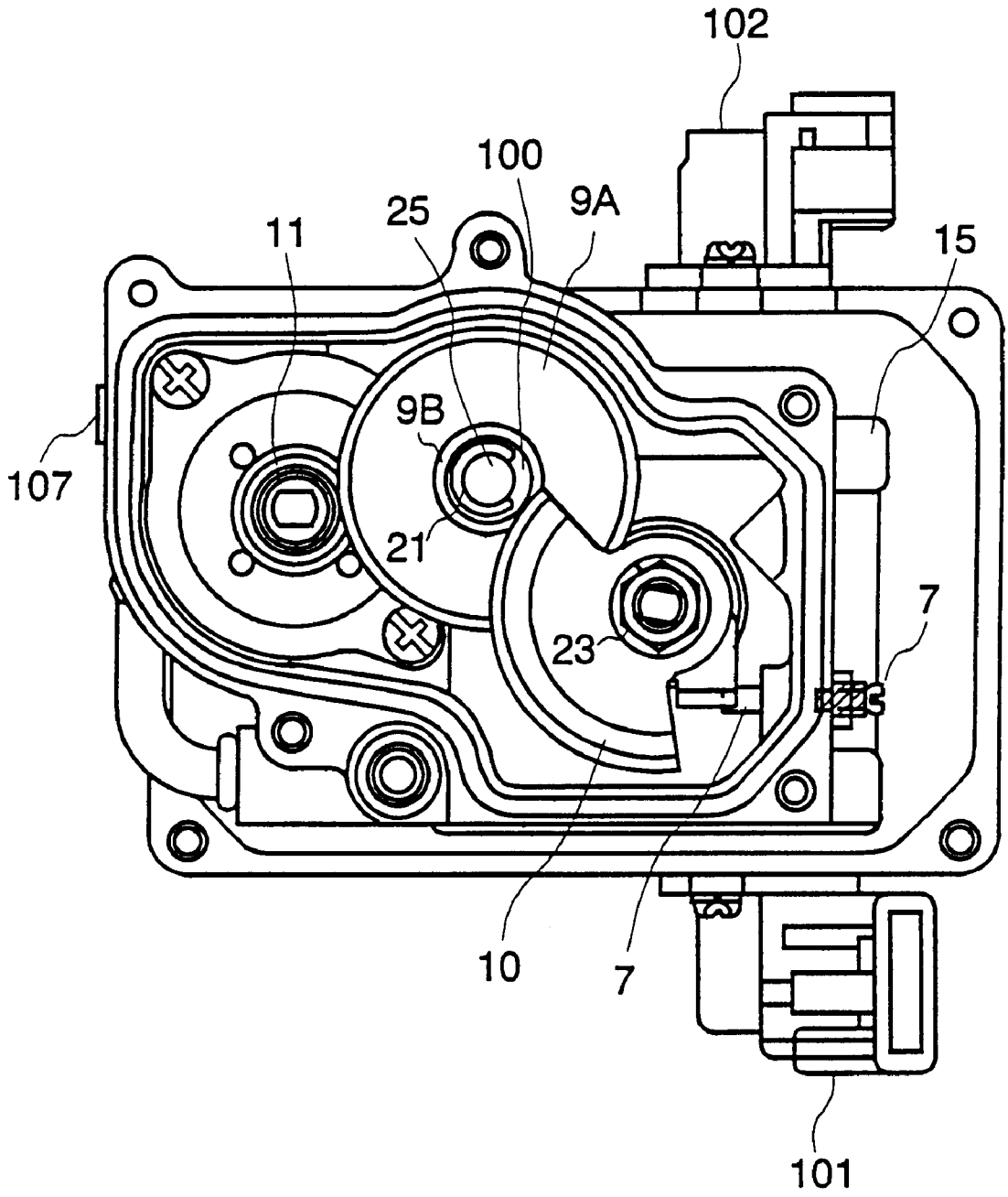
FIG. 5 is a view projected from a direction of C in FIG. 4A in which a cover 21 is detached.
Figure 6:
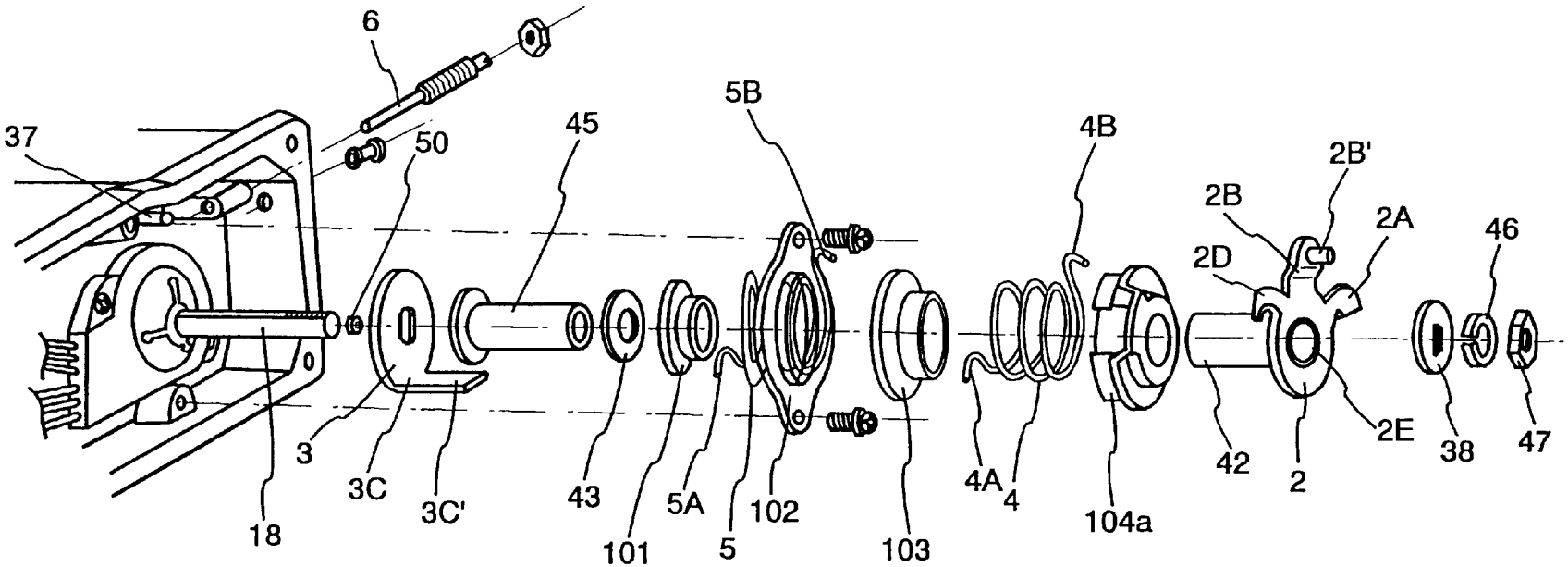
FIG. 6 is an exploded and perspective view of the major portion of the first embodiment.
Figure 7:
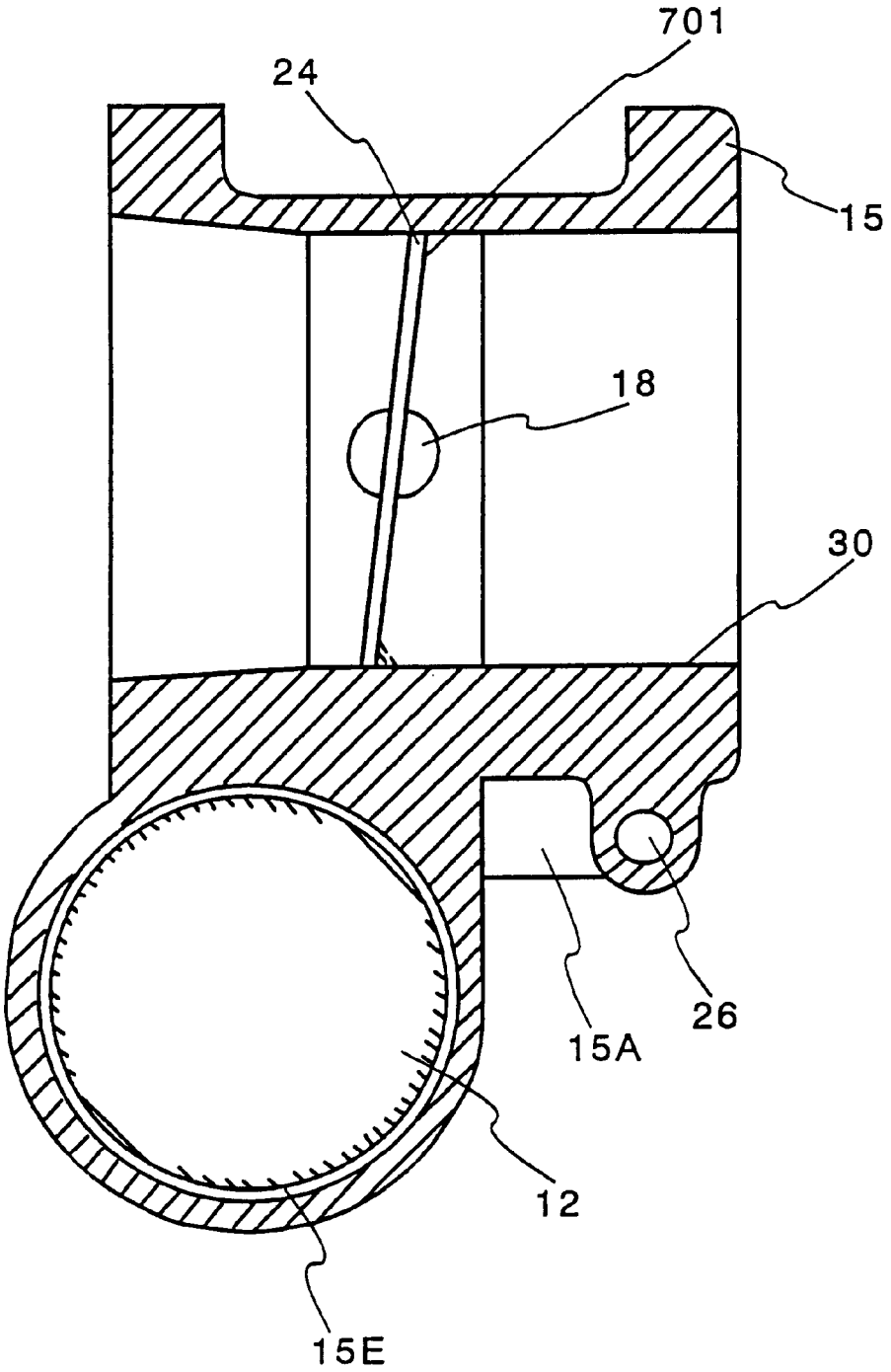
FIG. 7 is a cross-sectional view of the major part of the first embodiment.

FIG. 1 is a front view showing the throttle apparatus in one embodiment of the present invention, FIG. 2 is a view projected from A in FIG. 1, FIG. 3 is a view projected from B in FIG. 1, FIG. 4A is a sectional view taken along the line A—A in FIG. 3, FIG. 5 is a view projected from E in FIG. 4A with the gear cover removed, FIGS. 6 and 7 are sectional view of major parts, and FIGS. 8A to 14B show another embodiment of the present invention.

In those drawings, the throttle body 15 is, for example, made of aluminum die casting in which an intake air route (bore) 30 is formed. The throttle shaft 18 orthogonal to the intake air route 30 penetrates through the throttle body 15 and is rotated and supported through the bearings 28 and 29, and the throttle valve 24 for controlling the amount of the intake air in the intake air route 30 is fixed on the throttle shaft 18. The component 26 is a passage for engine coolant passing from water an inlet pipe 26*a* to an outlet pipe 26*b*. Using the engine coolant, the circumference of the throttle valve is heated and/or the motor 12 is cooled as described later.

The heat dissipation to the coolant and/or the heat transfer from the coolant are carried out partially via a rib 15A, and partially via the throttle body.

On the right and left side walls orthogonal to the throttle shaft 18 among the wide walls of the throttle body 15, the bearing accommodating part 15C and the case part 15A containing the driving gears of the electronic throttle controller are formed together with the body 15 on one side wall, and the bearing accommodating part 15D containing the bearings 28 and 31, and the case part 15B accommodating the limp home mechanism and the default opening setting mechanism of the throttle valve are placed on the opposite side wall.

The limp home mechanism is used for enabling the automobile to be continuously driven with a mechanical accelerator mechanism as an emergency treatment when the electronic throttle (the motor and other control systems) fails. The default opening setting mechanism is used for defining the default opening of the throttle valve 24 when the engine key is turned off (when the electric current is not supplied to the motor). For example, the default opening of the throttle valve is determined 5° (±0.2°) so as to be larger than the opening of the throttle valve at the fully closed position (the throttle valve fully closed position corresponds to the opening enabling to obtain the amount of the intake air for idling the engine. The structures of the limp home mechanism and the default opening setting mechanism will be described later in detail.

The gears accommodation case part 15A, which is covered by the removable cover 21 fixed with screws, accommodates the gears 11, 9A, 9B and 10 and so on of the throttle drive system in its inside 20. On the other hand, the case par 15B is covered by the removable cover 22 fixed with screws which accommodates the accelerator levers 1 and 1', the accelerator shaft 34 and the accelerator position sensor 13 and so on.

As shown in FIG. 6, the accelerator cover 22 has a boss part 90 supporting the accelerator shaft 34 passing through the cover 22 with the bearings 93 and 94, and the first accelerator lever 1 having an accelerator wire coupling part 33 is fixed at one end of the accelerator shaft 34.

The spring supporting member 91 is fitted around the boss part 90. The other end of the accelerator shaft 34 is lead inside the cover 22, and the second accelerator lever (cam lever) 1' is fixed at the other end of the accelerator shaft 34. The fixed positions of those levers 1 and 1' are established by the coupling between the fastening nuts 35 and 92 and the shoulder of the shaft 34.

The accelerator return spring 8 composed of a coil spring is placed around the spring supporting member 91. One end of the return spring 8 is connected to the first accelerator lever 1 and the other end of the return spring 8 is connected to the cover 22, and the return spring 8 energizes the accelerator shaft 34 and the accelerator levers 1 and 1' in the direction of their closed positions. In responsive to stepping over the accelerator pedal, the accelerator levers 1 and 1' rotates in the open direction against the force developed by the return spring 8 and transmitted through the wire.

In case that the throttle shaft 18 is driven electrically by the motor 12, the cam-type accelerator lever 1' never transmits the driving force to the throttle shaft 18. The component 95 is a sealing member.

Figure 8A:
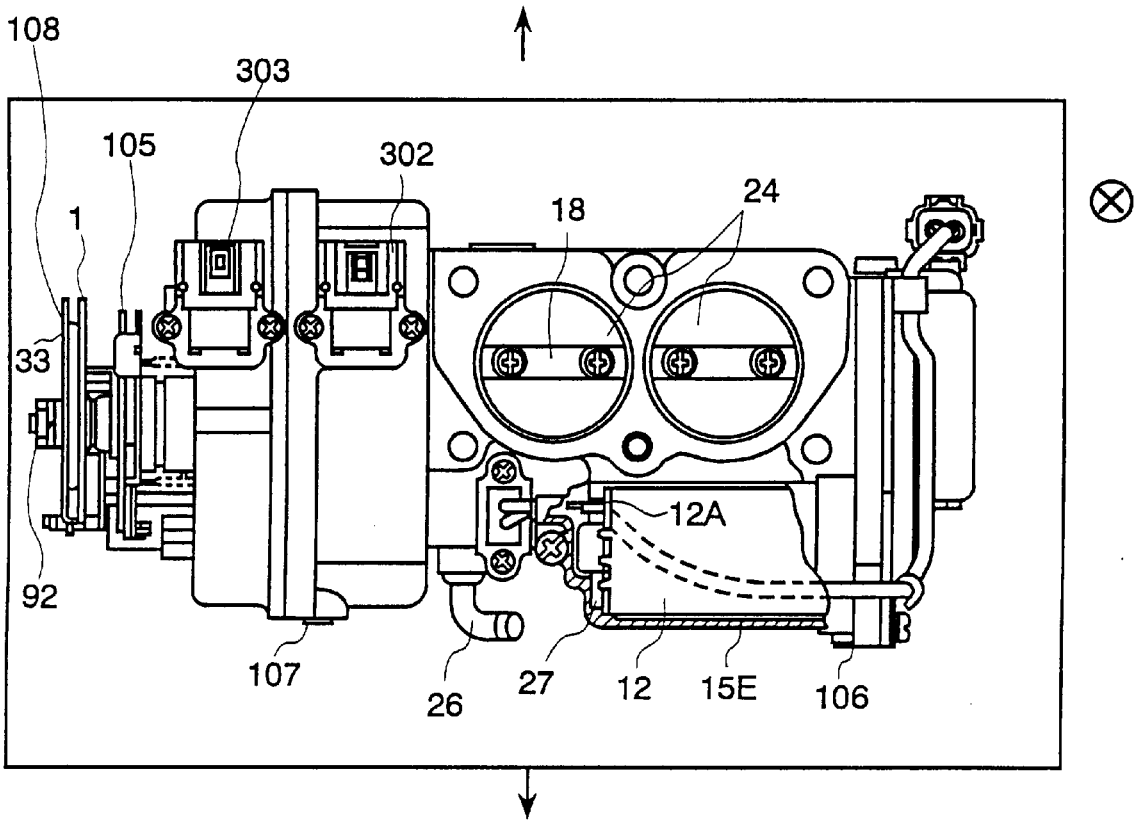
FIG. 8A is a general view showing the mounting state of an engine in the first embodiment.
Figure 8B:
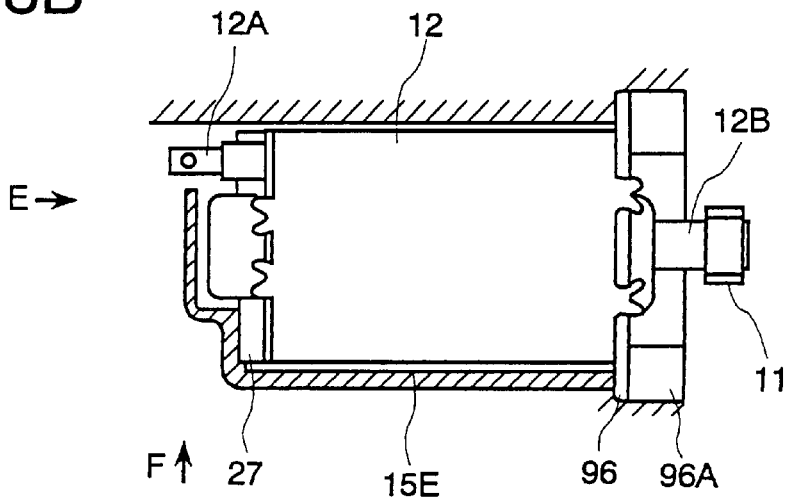
FIG. 8B is an enlarged view showing the motor portion of the first embodiment.
Figure 9:
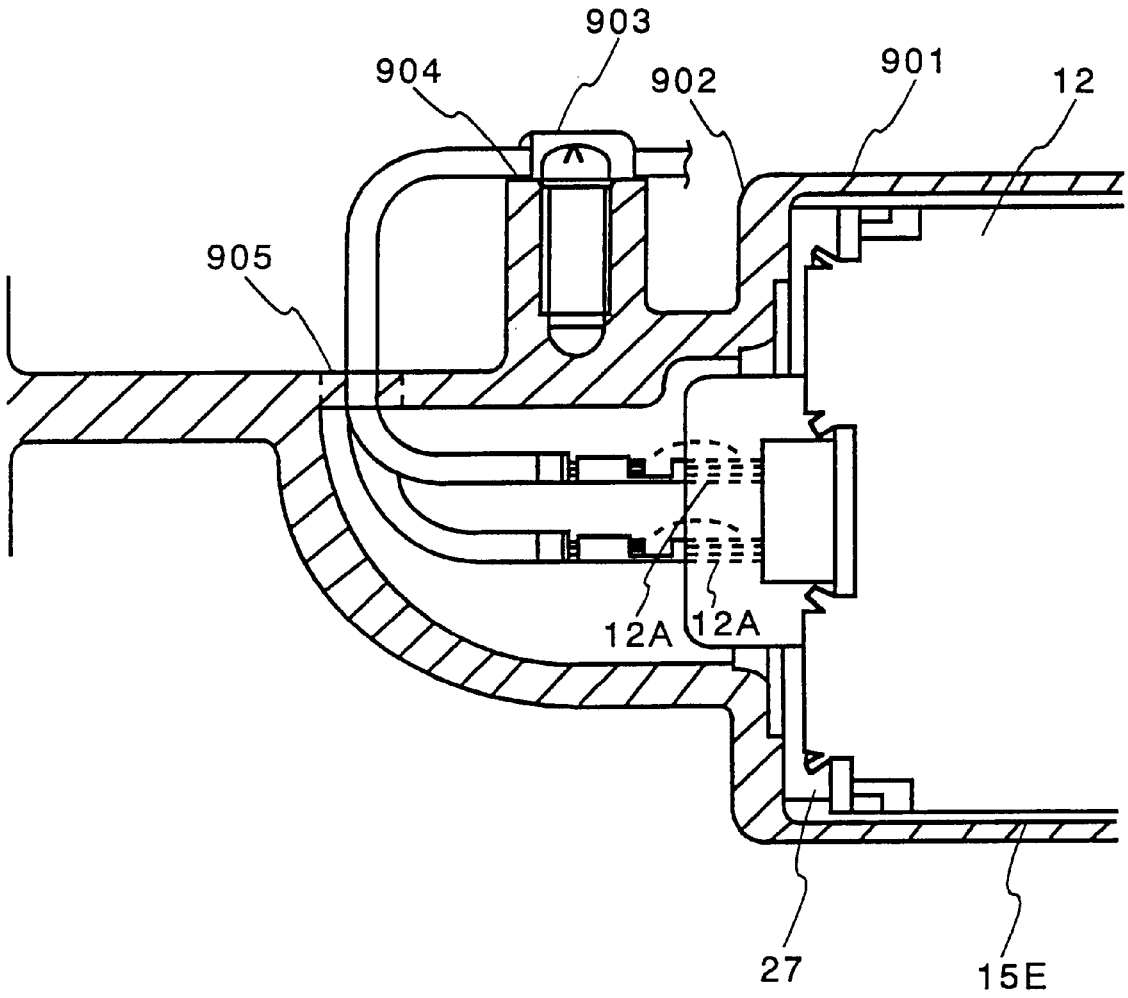
FIG. 9 is a view projected from a direction of F in FIG. 8.
Figure 10:
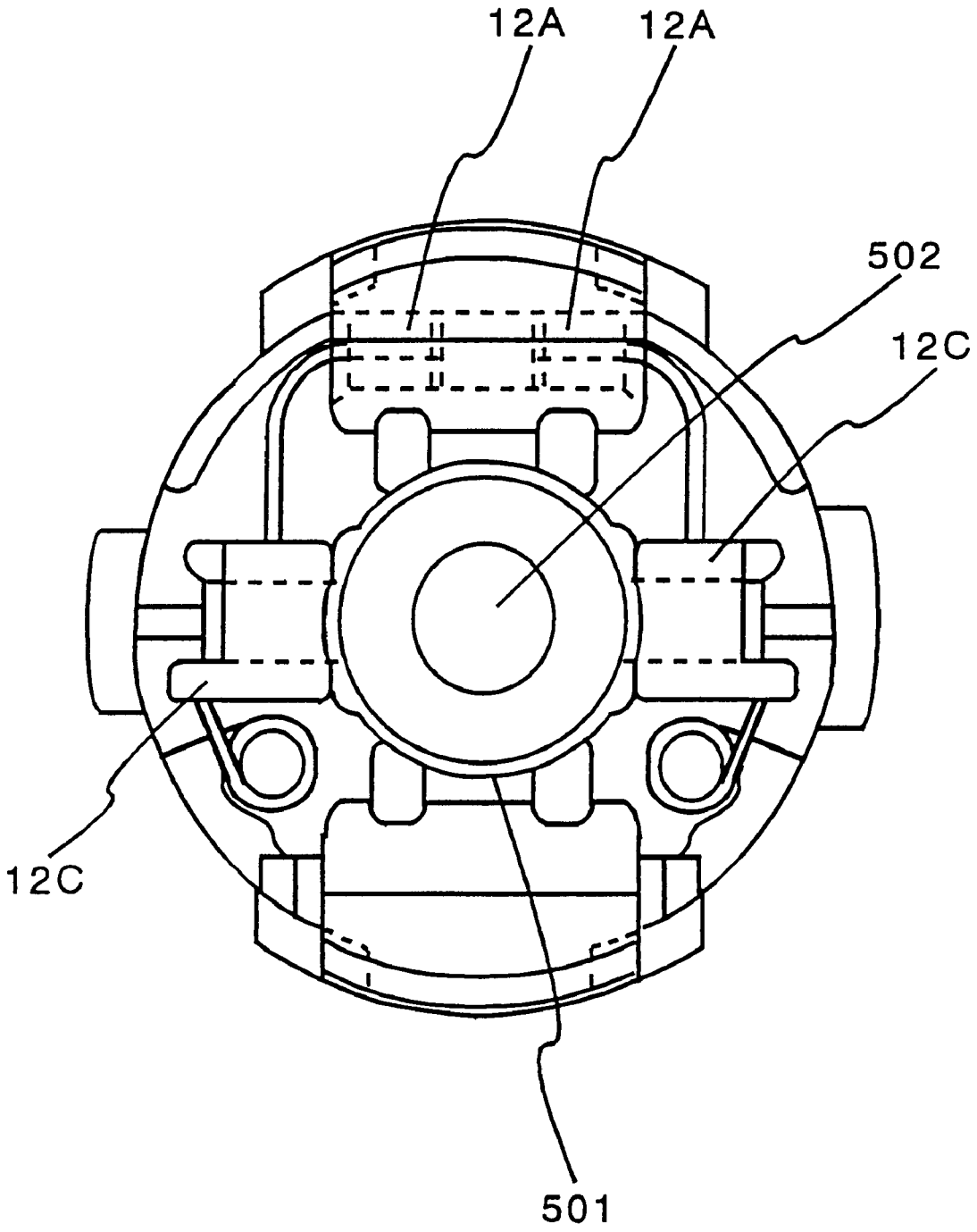
FIG. 10 is a view projected from a direction of E in FIG. 8.

The motor case part 15E is placed on a part (lower part in FIG. 8A and 8B of the side wall of the throttle body 15 so as to be parallel to the throttle shaft 18, and the motor 12 for the electronic throttle is accommodated in the motor case part 15E. DC motors and stepping motors are used for the motor 12. In addition, in FIG. 8A, the engine is placed rear the throttle apparatus (on the reverse side of the page space), and the vertical direction of the throttle apparatus is shown as in the figure. As shown in FIG. 10, the brush 12C in the motor is always on an even level, and the terminal 12A is positioned above the motor shaft. Further, in FIG. 8A, the aspiration hole is provided at both sides, the gear box (15A, 21) side and the accelerator box (15B, 22) side of the throttle apparatus. Thereby, it becomes possible to carry out the gas drainage of siliconee gas. As a result, the formation of the oxide film is prevented, and thus the failure of conduction of the sensor is prevented.

The inside surface of the motor case part 15E is tapered so that the motor 12 may be easily inserted, and the elastic member 27 is placed at the rear end of the case part 15E, the motor fixing plate 96 is placed at the case open part, and the motor fixing plate 96A separated to the motor is combined on the motor fixing plate 96, and then, the motor 12 is fixed by locking the screw 97 with the elastic member 27 and the motor fixing plates 96 and 96A.

The motor gear (pinion gear) placed on the shaft 12B of the motor 12 is engaged with the intermediate gear 9A. The gear radius (number of teeth) of the intermediate gear 9A is larger than that of the motor gear 11 in order to establish the function for slowing down and increasing torque, and thus, the increased rotational torque is transmitted further to the throttle shaft 18 through the intermediate gear 9B and the throttle gear 10. Wherein, the gear radius (number of teeth) of the throttle gear 10 is larger than that of the intermediate gear 9B. Therefore, the deceleration and the increase in torque is generated between them.

The intermediate gears 9A and 9B are integrated gears and fitted with the gear supporting shaft 25 placed so as to be parallel to the throttle shaft 18 so that the intermediate gears may rotates freely on the gear supporting shaft. One end of the gear supporting shaft 25 is supported by the pressure in the hole part of the side wall of the throttle body 15 and is held back by the E-ring 21 through the nylon washer 100 so that the intermediate gear 9 may stay on the shaft 25.

The throttle gear 10 is fixed on one end of the throttle shaft 18 by locking the nut 23. A sectoral gear as an example shown in FIG. 5 is used for the throttle gear 10. By means that, as the throttle gear 10 is made to be rotated in the close direction of the throttle valve, the one side of the throttle gear contacts to the throttle fully closed position adjusting screw (idle opening adjusting screw: first stopper) placed on the side wall of the throttle body 15, the rotational movement in the close direction of the throttle shaft 18 is limited up to this position, and consequently, the fully closed position of the throttle valve 24 can be determined. The fully closed position of the throttle valve is determined to be at the minimum opening enough to establish the amount of the air flow by which the idle speed of the engine is kept after warming up the engine.

As the electronic throttle method is applied to the throttle apparatus of this embodiment, the rotational torque generated by the power of the motor 12 is applied to the throttle shaft 18 through the above described gear mechanism as long as the drive motor 12 in the throttle control system operates normally.

The driving current is supplied to the motor 12 from the throttle control module (TCM) not shown. TCM determines the set value for the driving current in the following manner. By obtaining the throttle opening signal, the engine speed and the slip signal from the accelerator position sensor (for detecting the amount of stepping on the accelerator pedal 53 shown in FIG. 11), the signals are generated, corresponding to the various operation modes such as the normal engine control, the traction control, and the idle speed control.

The throttle shaft 18 and the accelerator shaft 34 are placed individually in an offset position so that the mechanical drive power may not be transmitted from the accelerator pedal 53 to the throttle shaft 18 as long as the throttle control system operates normally. The accelerator lever 1' and the lever 2 to be used as an element for the limp home mechanism are placed between the throttle shaft 18 and the accelerator shaft 34.

Now, the limp home mechanism and the default opening setting mechanism are described. In this embodiment, those mechanisms are placed at the opposite side to the gear mechanism of the throttle drive system across the throttle body 15.

The default opening setting mechanism is composed of a sleeve 42 with a lever 2 coupled at one end of the throttle shaft 18 and enabled to rotate around the shaft, a return spring (first energizing means) 4 energizing the sleeve 42 having the lever 2 in the close direction of the throttle valve 24, a throttle lever 3 fixed at one end of the throttle shaft 18 and enabled to engage with the lever 2 by the force applied by the return spring 4, a default opening adjusting screw (second stopper) 6 preventing the sleeve 42 with the lever 2 from rotating in the close direction at the default opening position when the electric current is not running into the motor (when the engine key switch is turned off), and a default opening spring (second energizing means) for applying a force for opening the valve to the throttle shaft 18 in order to keep a default opening.

The installation structure of those components are described by referring to FIGS. 4A to 4F and 6. In FIGS. 4A to 4F, reference numeral 101' designates a main throttle sensor terminal, 102' a sub throttle sensor terminal, 103' a sub accelerator sensor terminal, 104' a main accelerator sensor terminal, 105' an accelerator drum, 106 and 107 each designate a gas drainage, 108' an auto-cruise drum, and 401 an auto-cruise wire.

In the throttle shaft 18, at least one end of the throttle shaft 18 has a flat shape having a couple of parallel faces, and the spacer 50 is inserted into the one end of the shaft 18 and supported by the shaft shoulder part 18', and after the lever 3 is inserted, then the sleeve 45 is inserted, and the spring collar 101, the spring plate 102, the spring color 103 and the spring holder 104, all after the washer 43, and the sleeve 42 with the lever 2 are mounted outside of the sleeve 45, and the nut 47 is fastened with the washer 38 and finally the plate 46.

As shown in FIG. 4A, the sleeve (first sleeve) 45 is fixed on the periphery of the throttle shaft 18 by means that one end of the sleeve 45 contacts to the washer 38 and the other end of the sleeve 45 contacts the lever 3 by locking the nut 47. The locking force of the nut 47 is applied to the lever 3, the sleeve 45 and the washer 38. The sleeve 42 is enabled to rotate with respect to the throttle shaft 18 and the sleeve 45 so that the locking force may not be applied to the sleeve (second sleeve) with the lever 2 coupled with the outer periphery of the sleeve 45.

As shown in FIG. 4A, a solid lubrication material (dry bearing) 52 such as fluorine-contained polymers coating is coated on the inside face of the sleeve 42.

As shown in FIGS. 4A to 4F, FIG. 6 and FIG. 16, the lever 2 has arm portions 2A, 2B and 2D, and the central mount hole 2E is inserted into the outer periphery of the sleeve (coupling member) 42 and locked by force, and then, the lever is integrated with the metallic sleeve 42.

The arm portion 2A of the lever 2 is enabled to couple with the lever 3, the raised portion (roll pin) 2B' formed as a part of the arm portion 2B is enabled to couple with the accelerator lever (cam lever ) 1'. One end 5A of the default opening spring 5 is stopped at the raised portion 3C' formed as a part of the arm portion 3C, and the arm portion 2D is enabled to engaged to the default opening adjusting screw (second stopper) 6 placed on the side wall of the throttle body 18. The other end 5B of the default opening adjusting spring 5 is connected to the arm portion 2D of the lever 2.

Figure 16:
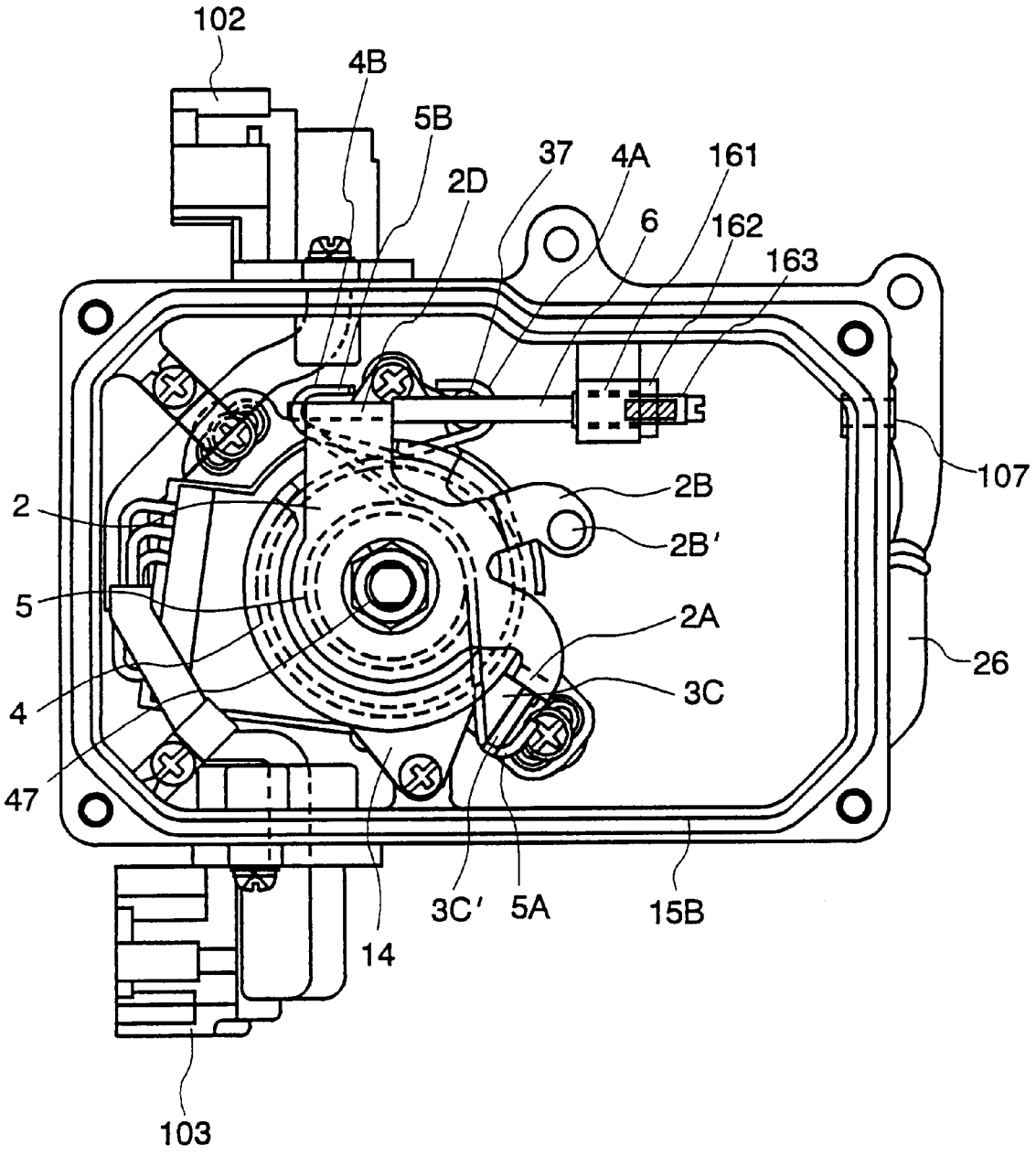
FIG. 16 is a view projected from a direction of D in FIG. 4A (a view projected from a direction of E in FIG. 13).

This adjusting screw (default screw) 6 and the arm portion 2D of the lever 2 are contacted to each other as shown in FIG. 4A and FIG. 16 which shows a view projected from the D direction of FIG. 4. The thread groove for the default screw 6 is provided in a boss of the body. The default screw 6 is fixed by a nut and sealed by the paint.

While the reference position of the throttle valve 24 is adjusted by using the screw (default screw), the re-adjustment of the screw becomes impossible.

In this embodiment, two coil springs with the same wire diameter and winding diameter are used for both of the return spring 4 and the default opening adjusting spring 5. Should one spring be cut off, the other performs the desired functions.

One end 4B of the return spring is coupled to the sleeve 42 and the other end of the return spring is coupled to the pin 37 placed on the side wall of the throttle body 15, and the arm portion 2A of the lever 2 is coupled to the lever 3 by the spring force applied by the return spring 4. With this coupling, the return spring 4 energizes the throttle shaft 18 and even the throttle valve 24 in the close direction.

Figure 11:
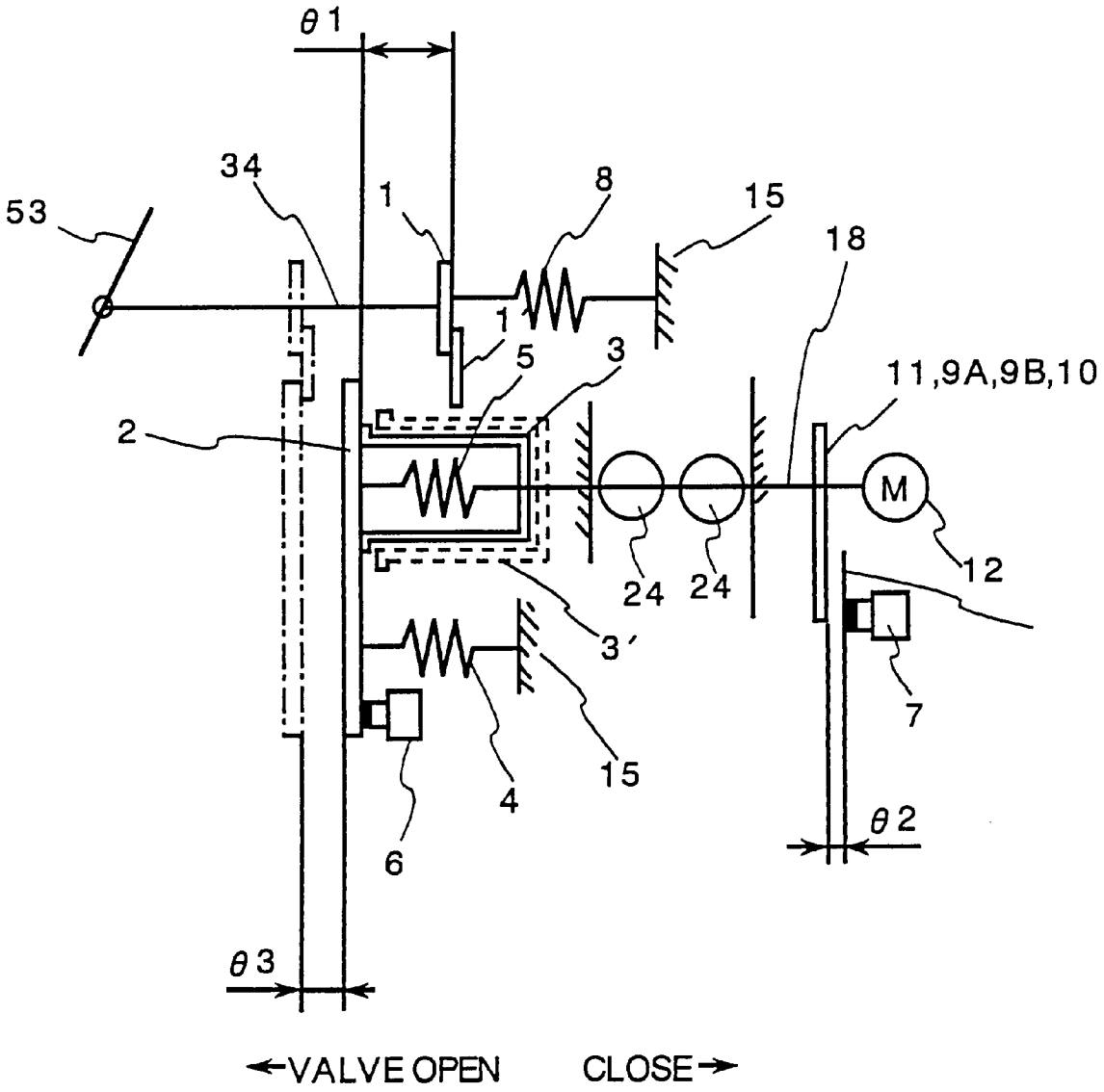
FIG. 11 is an explanatory view of the operational principle of the present invention.
Figure 12:
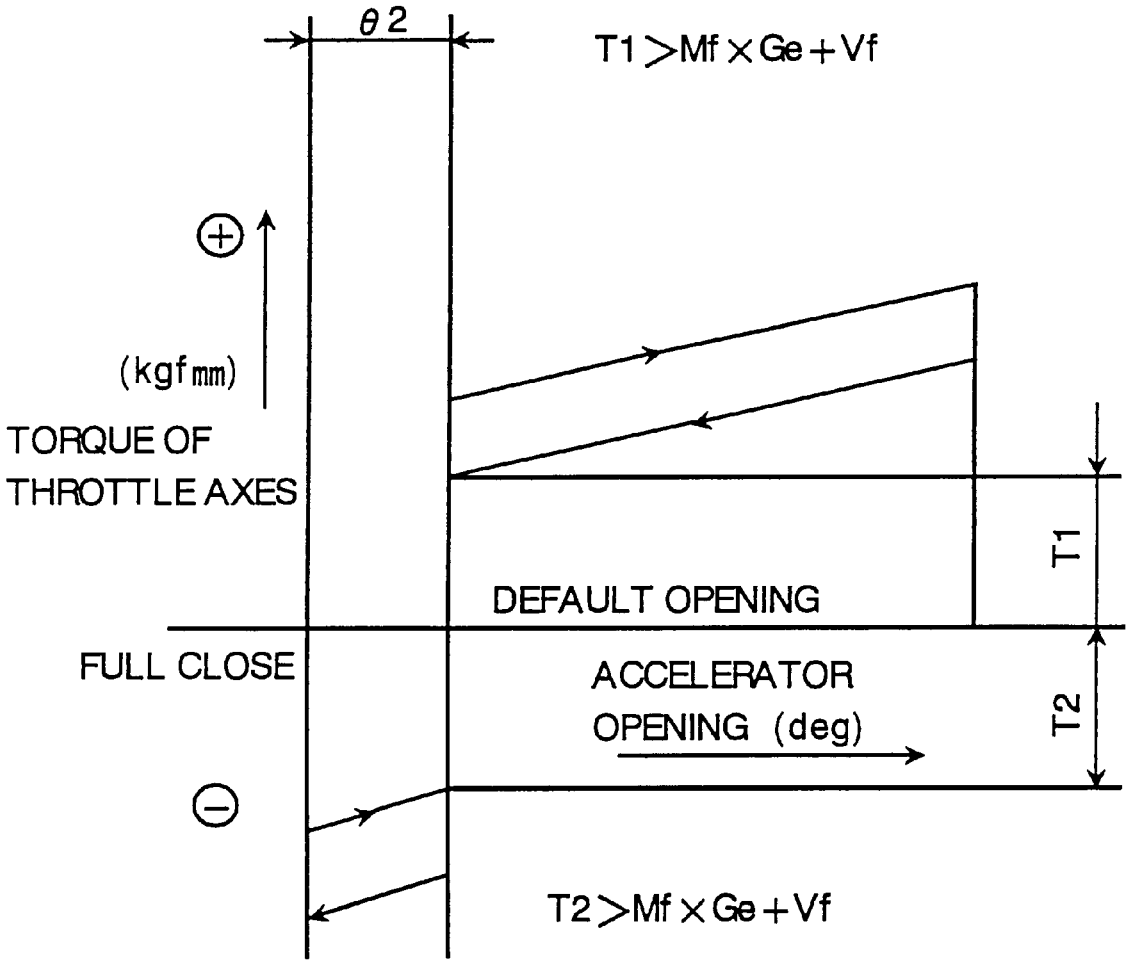
FIG. 12 is an explanatory view showing the characteristics of throttle shaft torque in the present invention.

Now, an example of operations of this embodiment is described by referring to FIG. 11 showing the principle and FIG. 12.

When the engine key is turned off (when the electric current is not supplied to the motor), the lever 2 energizes the throttle shaft 18 through the lever 3 in the close direction by the force applied by the return spring 4 in the close direction, and then, the throttle valve 24 is returned to the position corresponding to the default opening. The arm portion 2D of the lever 2 contacts to the stopper 6 at the default opening position, and the further rotational movement in the close direction is blocked.

Owing to the existence of the stopper 6, the spring force of the return spring 4 is made not to be effective on the throttle shaft when the opening of the position valve is from its default opening θ2 to its fully closed position, and by making effective (equivalent to applying the force for rotating the throttle shaft 18) only the default opening spring 5 on the throttle shaft around the fully closed position (between its fully closed position and its default opening θ2), in a non-conductive state, the default opening of the throttle valve 24 can be maintained.

The relationship between the energizing force P1 of the return spring 4 in the close direction and the energizing force P2 of the default opening spring 5 in the opening direction at their default opening positions is P1≧P2, and in other words, this relation to be satisfied is intended to establish that the relationship between the shaft torque T1 developed by P1 in the close direction and the shaft torque T2 developed by P2 in the opening direction is T1≧T2.

By keeping this default opening when the engine is stopped, the air flow required to start the engine can be obtained even in warming up the starting engine or in case that the throttle valve is adfreezed when it is very cold.

In case of idling the engine after warming up the engine, the throttle shaft 18 is forced by the drive force of the motor 12 in responsive to the idling control set value to rotate the throttle valve in the close direction against the spring force developed by the default opening spring 5. At this time, between the default opening position and the fully closed position, the coupling between the lever 3 and the lever 2 is released as shown in the broken line 3' in FIG. 11, and then the lever 3 along with the throttle shaft 18 shifts into a close direction.

In case of controlling the opening (open and close) of the throttle valve 24 at the opening position equal to or more than the default opening θ2, in an ordinary operational condition, the drive force of the motor 12 is transmitted to the throttle shaft 18 through the gear mechanisms 9 to 11, and the equilibrium balance between this force and the spring force developed by the return spring 4 establishes the control of the opening of the throttle valve 24. At this time, the lever 2 and the lever 3 are engaged with each other, and the sleeve 42 with the lever 2 rotates integrally with the throttle shaft 18 and the sleeve 45.

In case that the automobile driver steps fully on the accelerator pedal 53 when the automobile slips on the road, the motor 12 controls the throttle valve 24 in the close direction in responsive to the command from the throttle control module TCM in order to prevent the progression of the slip, the lever 2 is coupled and fastened to the accelerator lever 1' at its return movement in order to prevent the further rotational movement in the close direction. Even in this situation, the coupling between the lever 3, and the lever 3 is released from lever 2 and rotates in conjunction with the throttle shaft 18 in the close position and thus, the control of the throttle valve 24 in its close direction (traction control) is performed so as to be designed. If necessary, the throttle valve can rotate further to the close direction far from the position of the default opening against the force developed by the default opening spring 5.

In the traction control state, when the lever 2 is coupled and fastened to the accelerator lever 1' as described above, there arises such a phenomena (kick back phenomena) that the spring force of the return spring 4 is applied as a shock to the accelerator lever 1' through the lever 2.

Figures 15A, 15B:
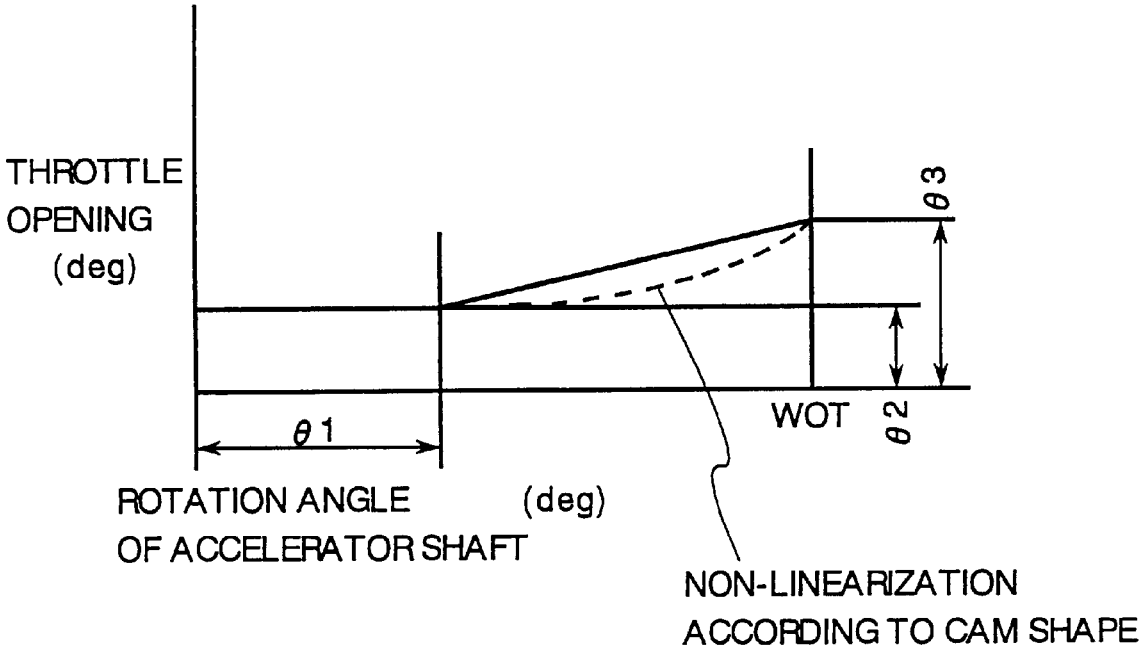
FIG. 15A is a view showing the relationship between the throttle opening and the accelerator opening in an embodiment.
FIG. 15B is a table representing the setting angles.

In this embodiment, in the case that an accelerator lever 1' and a lever 2 are engaged to each other when the rotation angle is more than θ1, a cam 1B of the accelerator lever 1' contacts a roller of the lever 2 as shown in FIG. 15A. Therefore, as shown in a dotted line or a solid line of FIG. 15A, the characteristics of the opening of the accelerator shaft and the opening of the throttle can be freely selected by changing the shape of the cam.

Figure 4F:
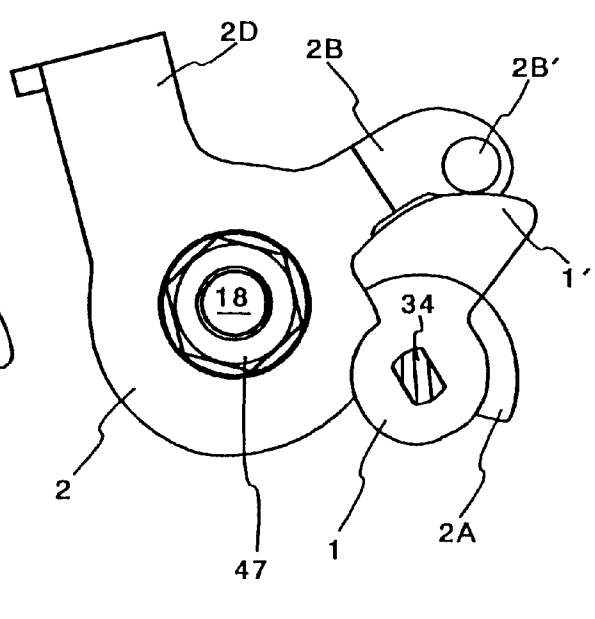
FIG. 4F shows another state of the limp home or the traction control.
Figure 4E:
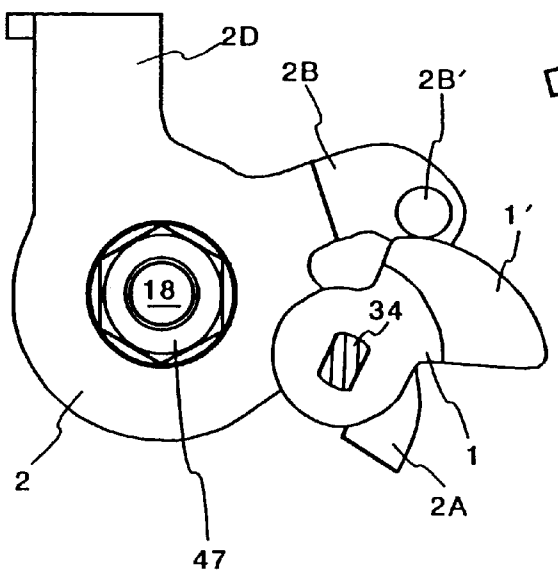
FIG. 4E shows one state of the limp home or the traction control.
Figure 4D:
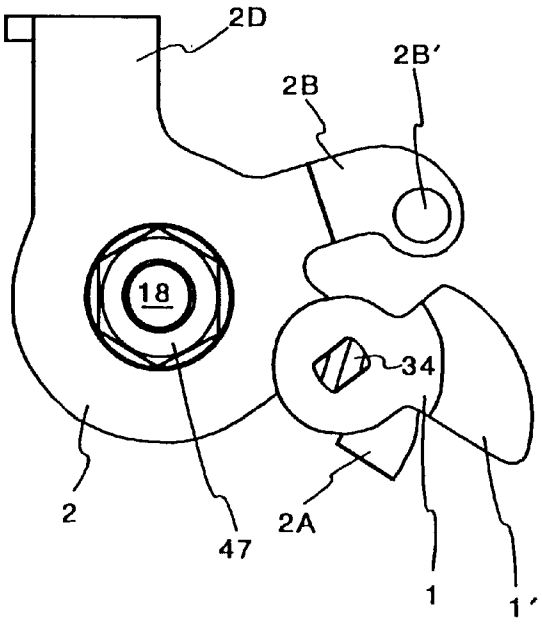
FIG. 4D is an explanatory view of a cam 1' and a lever 2 of FIG. 4A.

The relationship between the cam lever 1 and the roller 2B is shown in FIGS. 4D to 4F.

FIG. 4D shows the relationship between them in a normal control state. The cam 1' of the accelerator lever 1 always rotates in an non-contact state. FIG. 4E shows one state of the limp home or the traction control, and it shows the 91 state of FIG. 15. FIG. 4F shows another state of the limp home or the traction control, and it shows the state in the neighborhood of WOT of FIG. 15.

As it is required to ensure the accelerator opening θ3 necessary for the self-move of the automobile when the limp home operation, the cam characteristic (throttle opening vs. accelerator opening characteristic) is defined to be a linear gradient by controlling the shape of the cam of the accelerator lever 1' as shown in the solid line of FIG. 15A.

In this embodiment, as shown in FIG. 15B, definitions include that θ1=30°, θ2 (default opening)=5°, and θ3 (throttle opening required for the limp home operation)=7°. If the characteristic shown in the dotted line is used, there is an advantage which can decrease the force that the spring force of the return spring acts on the accelerator pedal.

The sleeve 42 may rotate relatively on the sleeve 45 when the opening of the throttle valve 24 is from its default opening θ2 and its full-open position, and even in case of the traction control, the sleeve 42 may rotate relatively on the sleeve 45 as shown above. The friction between the both is reduced by the solid lubrication material 52.

The limp home mechanism operates as described below.

When some failures occur in the throttle system or the motor 12, the throttle valve 24 is returned to its default opening position by the spring force of the return spring 4. When the accelerator pedal 53 is step on by θ1 or more in this state, the cam loop 1'A of the accelerator lever 1 is made to be coupled to the lever 2 and the lever 2 is made to be rotated in the open direction of the throttle valve as shown by the alternate long and short dash line in FIG. 11. From the default opening position to the fully closed position, the throttle shaft 18 and the lever 3 follow the rotational movement of the lever 2 in the open direction by the force of the spring 5 as shown in the solid line, and the throttle valve 24 opens, and then, the self-move (limp home) operation of the automobile by the accelerator pedal is enabled.

In this case, in order to guarantee the limp home operation, it is required for the shaft torque T1 developed by the energizing force P1 of the return spring 4 to satisfy the condition defined by the following equation at least from the default opening 2 to the throttle fully closed position, and it is required for the shaft torque T2 developed by the energizing force P2 of the return spring 5 to satisfy the condition defined by the following equation at least from the throttle fully closed position to the limp home operation region.

[Formula 1]

The conditions, $$T1>Mf\times Ge+Vf$$

$$T2>Mf\times Ge+Vf$$

are required to be satisfied.

Where, Mf: the torque of static friction of the motor, Ge: the deceleration ratio, and Vf: the torque on the throttle shaft, required to open the throttle valve The effects of this embodiment is described below.

a. Excluding the case that it is exceptional for the opening region almost from the default opening to the throttle full-open (when the throttle valve is closed by the motor and when the accelerator pedal is fully step on by the traction control), the sleeve 42 with the lever 2 used for throttle shaft drive rotates on the throttle shaft 18 in conjunction with the sleeve 45, and therefore, the friction between the sleeve 42 and the sleeve 45 can be almost removed.

Therefore, the force P1 of the return spring may be small enough, and hence, the required shaft torque T1 of the throttle shaft 18 may be reduced, which leads to the reduction of the load of the motor drive. In addition, the shaft step torque T1−(−T2) of the throttle shaft torque generated at the opening position over the throttle default opening position can be reduced, and hence, the stability of the throttle drive control can be increased.

b. As the components as the structural elements of the default opening setting mechanism such as spacer 50, washer 51, chip 38 with the default opening spring 5, sleeve 45, sleeve 42 with the return spring 4 and the lever 2, and lever 3, can be inserted into the throttle shaft 18 in a designated order and assembled together only by locking the screw, the rationalization of the fabrication work can be established.

c. By means that the default opening setting mechanism, the limp home mechanism, the throttle sensor 13, the accelerator sensor 14 and the cover 22 of the case 15B are laid out intensively, and that common parts are used partially for those mechanical components, the number of components can be reduced and the rationalization of the structure as well as the reduction of the size of the apparatus can be established. In addition, by using spiral springs overlapped inside and outside as the return spring 4 and the default opening spring 5, further reduction of the size of the apparatus can be achieved.

In case of using spiral springs, the spring constant is designed to be small in order to progress the reduction of the load for the motor 12.

d. The stopper (idle opening adjusting screw) 7 of the fully closed position setting mechanism and the stopper (initial opening adjusting screw) 6 of the default opening setting mechanism can be adjusted for setting a designated opening, and both of the stoppers are placed on the opposite internal surface of the throttle body side wall. Owing to this mechanism and structure, individual stoppers can be identified separately by recognizing the directions of the wide wall and the existence of the gear mechanism and the default opening mechanism, which can prevents the false recognition of the individual stoppers and the fault in settings.

Because it is impossible to change the opening in a market after shipping the product, by installing inside of the case 15B as is the adjusting screw for the setting of the default opening, it becomes possible to have a damper-proof function, Further, by enabling the stopper (idle opening adjusting screw) 7 to contact to one side of the sectoral gear 18 of the reduction gear mechanism, a part of the gear can be also used as a stopper coupling member at the throttle shaft side.

e. Even by mixing the limp home mechanism and the default opening mechanism, the smooth operation of the throttle shaft can be ensured so that the operation of the throttle shaft may not be interrupted by the limp home mechanism at the traction control operation.

Figure 14B:
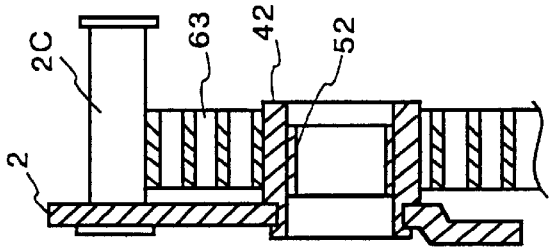
FIGS. 14A and 14B are cross-sectional views showing a second embodiment of the present invention.
Figure 14A:
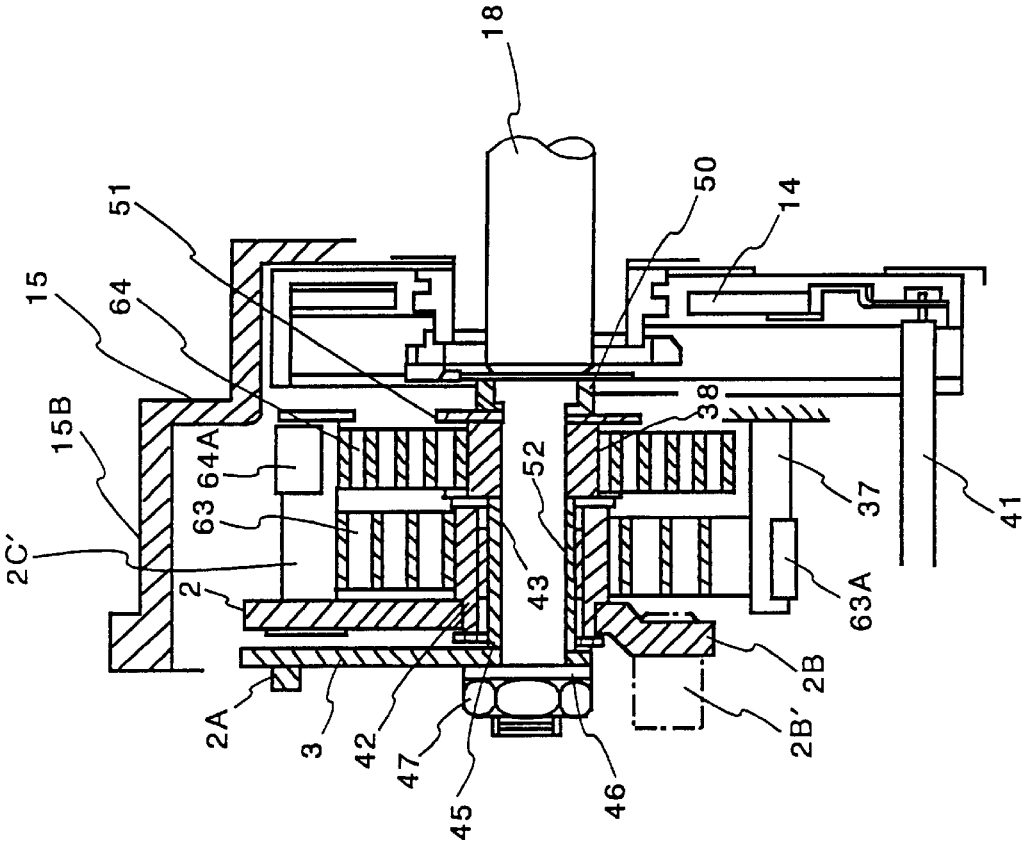
Figure 21:
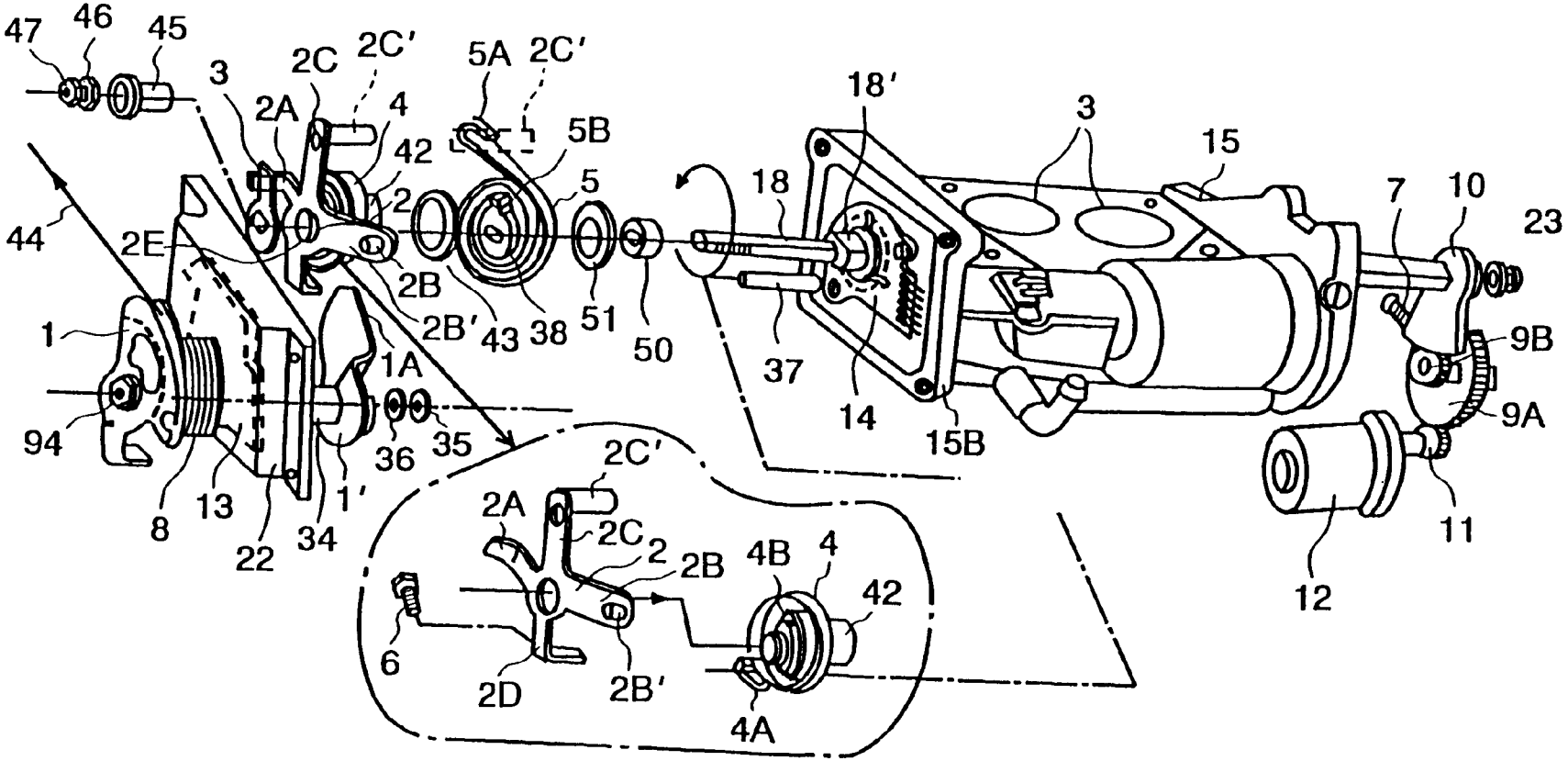
FIG. 21 is an exploded and perspective view of the embodiment shown in FIGS. 14A and 14B.

The second embodiment is described by referring to FIGS. 14A, 14B and 21.

The principle structure of this embodiment is the same as that of the first embodiment, except that the used components are partially modified. In the following, only the different features in this embodiment are described. In those figures, like numerals are assigned to the same components as should in FIG. 1. FIG. 21 is an exploded and perspective view of the embodiment shown in FIGS. 14A and 14B.

In this embodiment, a torsion spring 63 shaped in a spiral is used as the return spring, and a torsion spring 64 shaped in a spiral is used as the default opening spring.

The default opening setting mechanism comprises a sleeve 42 with the lever 2 engaged rotatably with one end of the throttle shaft 18, a return spring 63 (first energizing means) for energizing the sleeve 42 with the lever 2 in the close direction of the throttle valve 24, the lever 3 possible to engage the lever 2 by the spring force of the return spring 63 fixed on one end of the throttle shaft 18, the default opening adjusting screw (second stopper) to prevent the sleeve 42 with the lever 2 from rotating in the close direction at a default position during the non-conduction of the motor (i.e. during the switch-off state of an engine key), a default opening spring (second enegizing means) 64 for providing to the throttle shaft 18 the valve-open force to maintain the default opening.

As shown in FIG. 14A, at least one end of the throttle shaft 18 has a flat shape having a couple of parallel faces, and the spacer 50 is inserted into one end of the shaft 18 so as to contact with the step part of the shaft, and after the washer 51 is inserted, the chip 38 with the default opening spring 64 is inserted and coupled and next, the sleeve with the lever 2 is engaged through the sleeve 45 after the nylon washer 43, and further, the lever 3 is inserted into the throttle shaft 18 so as to couple with the shaft, and finally, the nut 47 is fasten with the washer 46.

As shown in FIGS. 14A and 14B, one end of the sleeve (first sleeve) 45 contacts to the chip 38 by fastening the nut 47, and the sleeve 45 is fixed on the periphery of the throttle shaft 18 by the other end contacting to the lever 3. The fastening force by the nut 47 is provided to the lever 3, the sleeve 45 and the chip 38, and the rotational movement of the sleeve 42 is enabled in relative to the throttle shaft 18 and the sleeve 45 by means that the fastening force is not applied to the sleeve (second sleeve) 42 with the lever 2 engaged on the periphery of the sleeve 45.

One end 4A of the return spring 63 is coupled to the sleeve 42, and its other end 63B is coupled to the pin 37 mounted on the side wall of the throttle body 15, and the arm portion 2A of the lever 2 is coupled to the lever 3 by the spring force of the return spring 63. Owing to this mechanical coupling, the return spring 63 energizes the throttle shaft and even the throttle valve 24 in the close direction.

As shown in FIG. 21, the lever 2 has arm portions 2A to 2D, and the central mount hole 2E is inserted into the outer periphery of the sleeve (coupling member) 42 and locked by force, and then, the lever is integrated with the metallic sleeve 42.

As shown in FIG. 14B, a solid lubrication material (dry bearing) 52 such as fluorine-contained polymers coating is coated on the inside face of the sleeve 42.

The arm portion 2A of the lever 2 is enabled to couple with the lever 3, the raised portion (roll pin) 2B, formed as a part of the arm portion 2B is enabled to couple with the accelerator lever (cam lever ) 1', one end 5A of the default opening spring 5 is coupled (linked) with the raised portion 2C' formed as a part of the arm portion 2C, and the arm portion 2D is enabled to be coupled to the default opening adjusting screw (stopper) 6 placed on the side wall of the throttle body 18. The other end 5B of the default opening adjusting spring 64 is connected to the chip 38.

According to this embodiment, the following effects are obtained in addition to the effects brought by the first embodiment.

It may be allowed to place the return spring 63 outside and to place the default opening spring 64 inside.

Figure 13B:
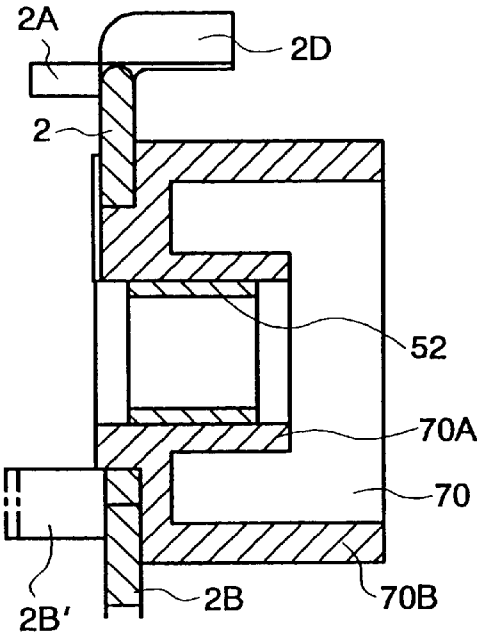
FIGS. 13A and 13B are cross-sectional views showing a third embodiment of the present invention.
Figure 13A:
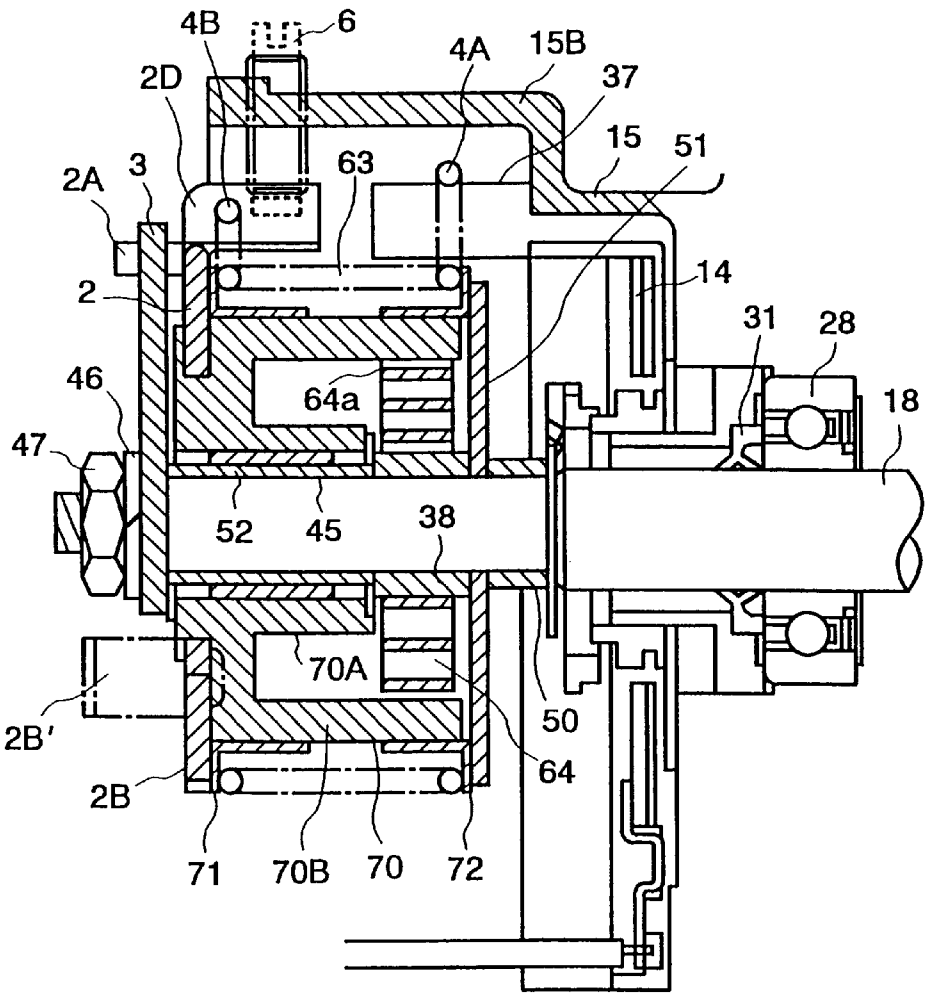
Figure 17:
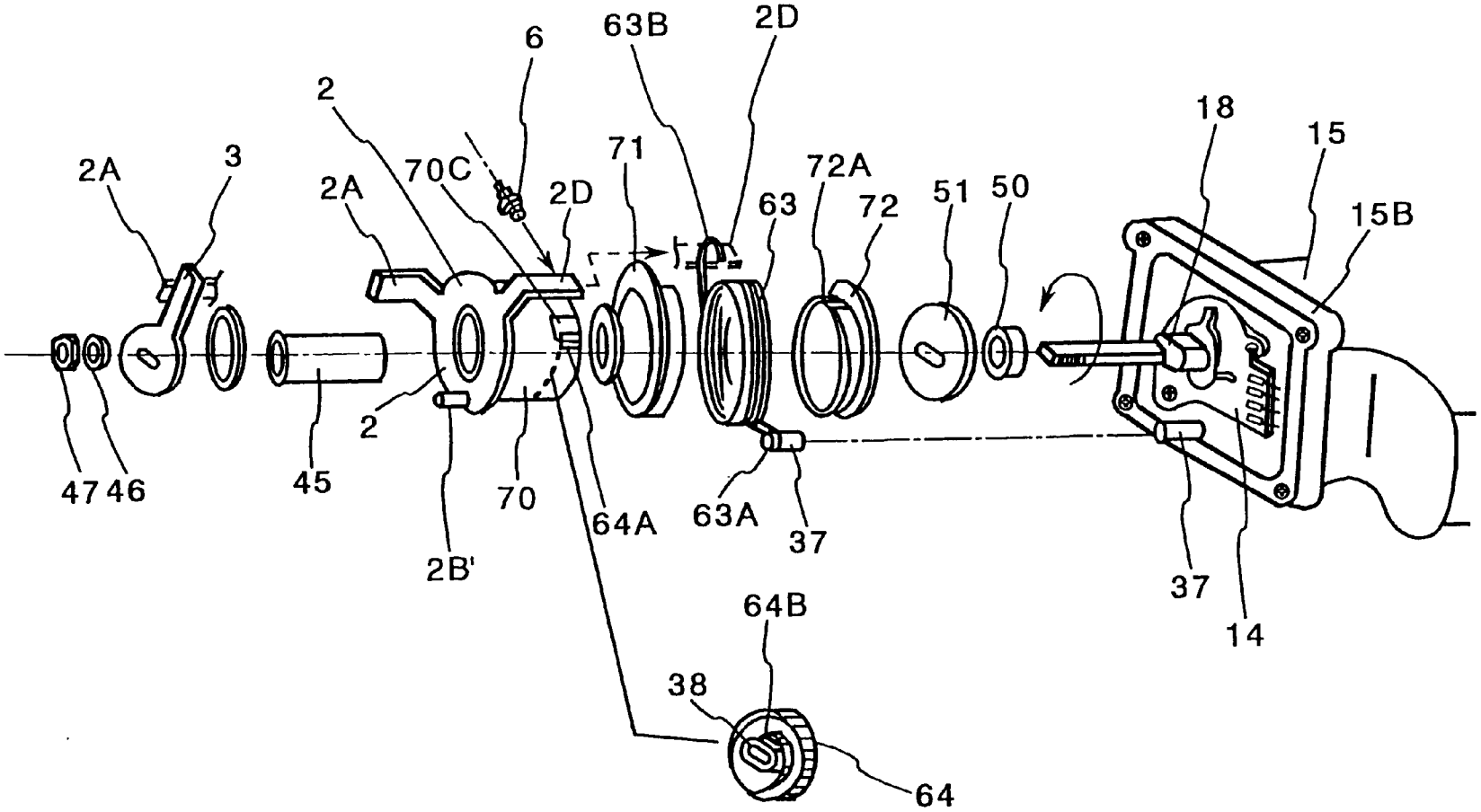
FIG. 17 is an exploded and perspective view of the embodiment shown in FIG. 13.

Next, the third embodiment is described by referring to FIGS. 13A, 13B and 17.

FIG. 13A and 13B are cross-sectional view of the major part of the third embodiment, and FIG. 17 is its exploded and perspective view. Although not shown in FIGS. 13A, 13B and 15, the intake air passage 30 of the throttle body, the mounting structure of the throttle valve 24, the gear structures 9A, 9B, 10 and 11, and the mounting structure of the accelerator shaft 34 of the accelerator cover 22 and the levers 1 and 1' are the same as those in the previous embodiments.

In this embodiment, either one of the return spring and the default opening spring is formed as a coil-type torsional spring and the other is formed as a spiral coil. In this example, the return spring 63 is formed by a coil-type torsional spring and the default opening spring 64 is formed by a spiral spring.

For the sleeve with a lever 2, the sleeve 70 is used in stead of the sleeve 42 used in the previous embodiments.

As shown in FIG. 13B, the sleeve 70 is composed of the internal cylinder part 70A engaged with the sleeve 45 and enabled to rotate in relative to the sleeve 45 and the external cylinder part 70B placed outside.

Making the length of the internal cylinder part 70A smaller than the length of the external cylinder part 70B, and using the inner space of the sleeve 70 defined by the length difference between the internal cylinder part 70A and the external cylinder part 70B and setting the default opening spring 64 on the throttle shaft 18 through the chip 38, one end 64A of the default opening spring is made to be coupled with the notch (not shown) formed on the holder 70 (the other end 64B is coupled with the chip 38).

The spring holders 71 and 72 separated in the axial direction is installed at the external cylinder part 70B of the sleeve 70.

The return spring 63 is supported by the spring holders 71 and 72, and its one end 63A is coupled to the pin 37 of the throttle body 15 through the notch 72A formed on the holder 72, and the other end 63B is coupled to the arm portion 2D of the lever 2.

This embodiment has the same effect as the first embodiment, and further provides the following effects.

h. Even in case of using different types of coils such as coil-type torsional spring and spiral coil for the return spring and the default opening spring, it will be appreciated that those coils can be integrated and placed in a single sleeve and that the size of the apparatus can be reduced.

Figure 18:
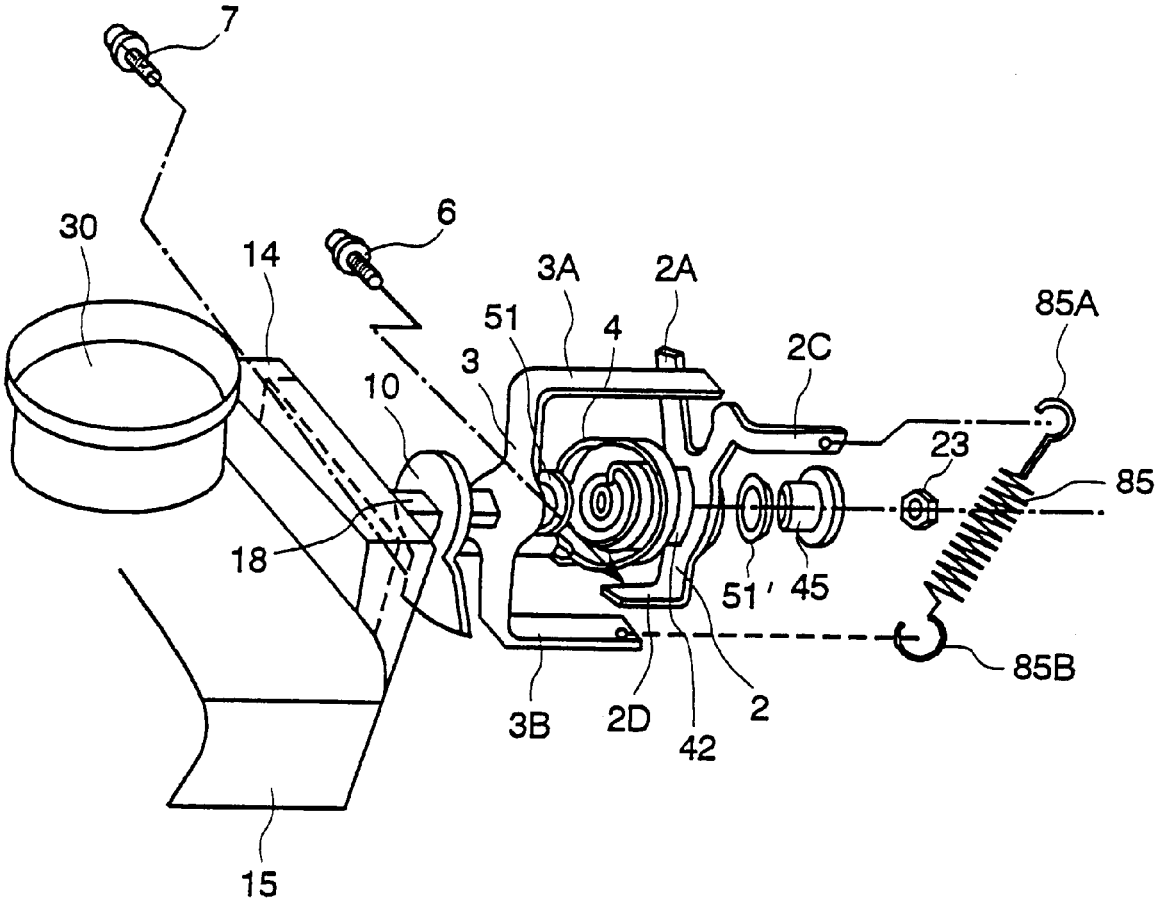
FIG. 18 is an exploded and perspective view of the embodiment shown in FIG. 4A.
Figure 19A:
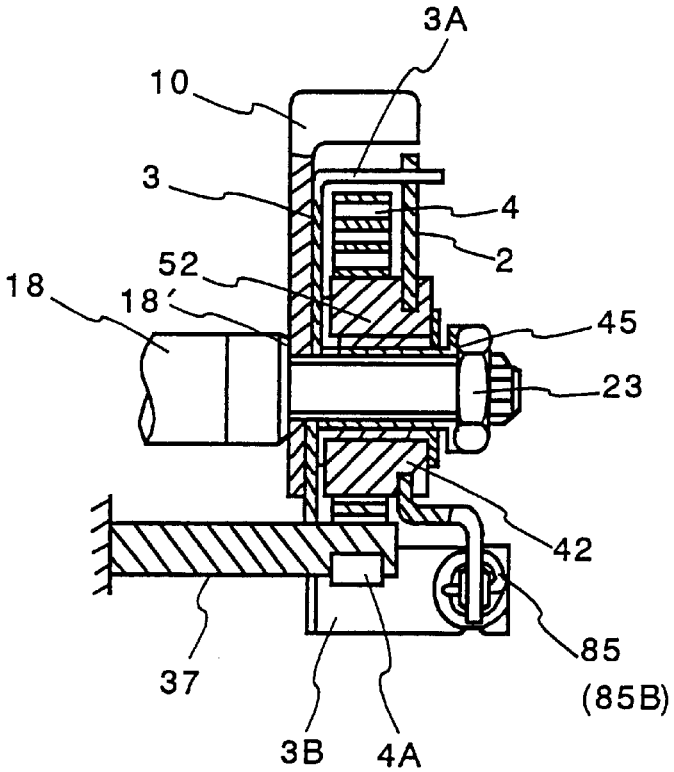
FIG. 19A and 19B are sectional views showing the major portion of FIG. 18.
Figure 19B:
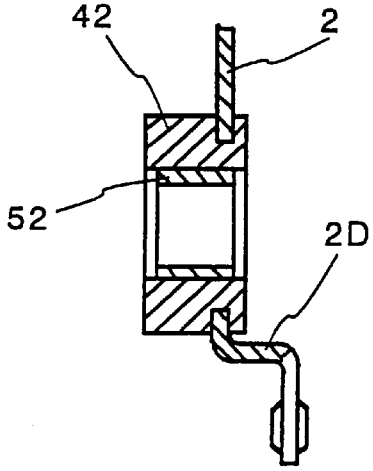

FIG. 18 is an exploded and perspective view of the forth embodiment and, FIG. 19 is a cross-sectional view of its major part.

In this embodiment, one of the return spring and the default opening spring is formed as a spiral spring and the other is formed as a tensile spring, and the default opening setting mechanism is located at the side of the gear mechanism of the throttle drive system in order to reduce the size of the body. As for the gear mechanism, only the throttle gear 10 is shown but gears 9A, 9B and 11 are not shown.

In this example, as shown in FIG. 18, the throttle gear 10 and the lever 3 are fixed in order at one end of the throttle shaft 18 at the gear mechanism side, and next, the washer 51, the return spring 4, the sleeve 42 with the lever 2, the washer 51' and the sleeve 45 are inserted, and finally, those components are fastened by the nut 23. A spiral spring is used for the return spring 4. As described later, a tensile spring is used for the default opening spring 85.

As in the previous embodiments, the sleeve 45 is fixed on the throttle shaft 18 by the interaction between the fastening force of the nut 23 and the throttle shaft step 18', and the sleeve 42 is coupled and engaged with the periphery of the sleeve 45 so as to be enabled to rotate in relative to the sleeve 45 and the shaft 18.

As shown in FIG. 19A, one end 4A of the return spring 4 is coupled to the pin 37 fixed on the throttle body 15, and the other end is coupled to the sleeve 42 so that the sleeve 42 and the lever 2 may be energized in the close direction of the throttle valve.

The arm portion 3A of the lever 3 is enabled to be coupled to the arm portion 2A of the lever 2, and its lever 3B is coupled with one end 85B of the default opening spring 85. One end of the default opening spring 85 is coupled with the arm portion 2C of the lever 2, and its another end is connected with the arm portion 3B of the lever 3.

Also in this embodiment, as in the previous embodiment for the default opening setting operation, when the engine key is turned off, the spring force of the return spring 4 is transmitted to the throttle shaft 18 through the lever 2 and the lever 3, and the arm portion 2D of the lever 2 contacts to the adjusting screw 6 at the default opening position, and then, the default opening of the throttle valve is held by the force developed by the default opening spring 85.

As the motor is driven in the close direction against the tensile force of the default opening spring 85, the full-close position of the throttle valve is established at the position of the fully closed position adjusting screw 7.

The throttle sensor 14 is also placed on the side wall of the throttle body at the gear mechanical side.

This embodiment basically brings the same effect as the previous embodiments, and the following effects can be also obtained.

i. The gear mechanism and default opening mechanism of the throttle drive system can be placed intensively. As the gear mechanism, the return spring and the default opening spring are placed near the shaft 18, the torque generated and interacted in the opposite direction can be reduced.

Figure 20:
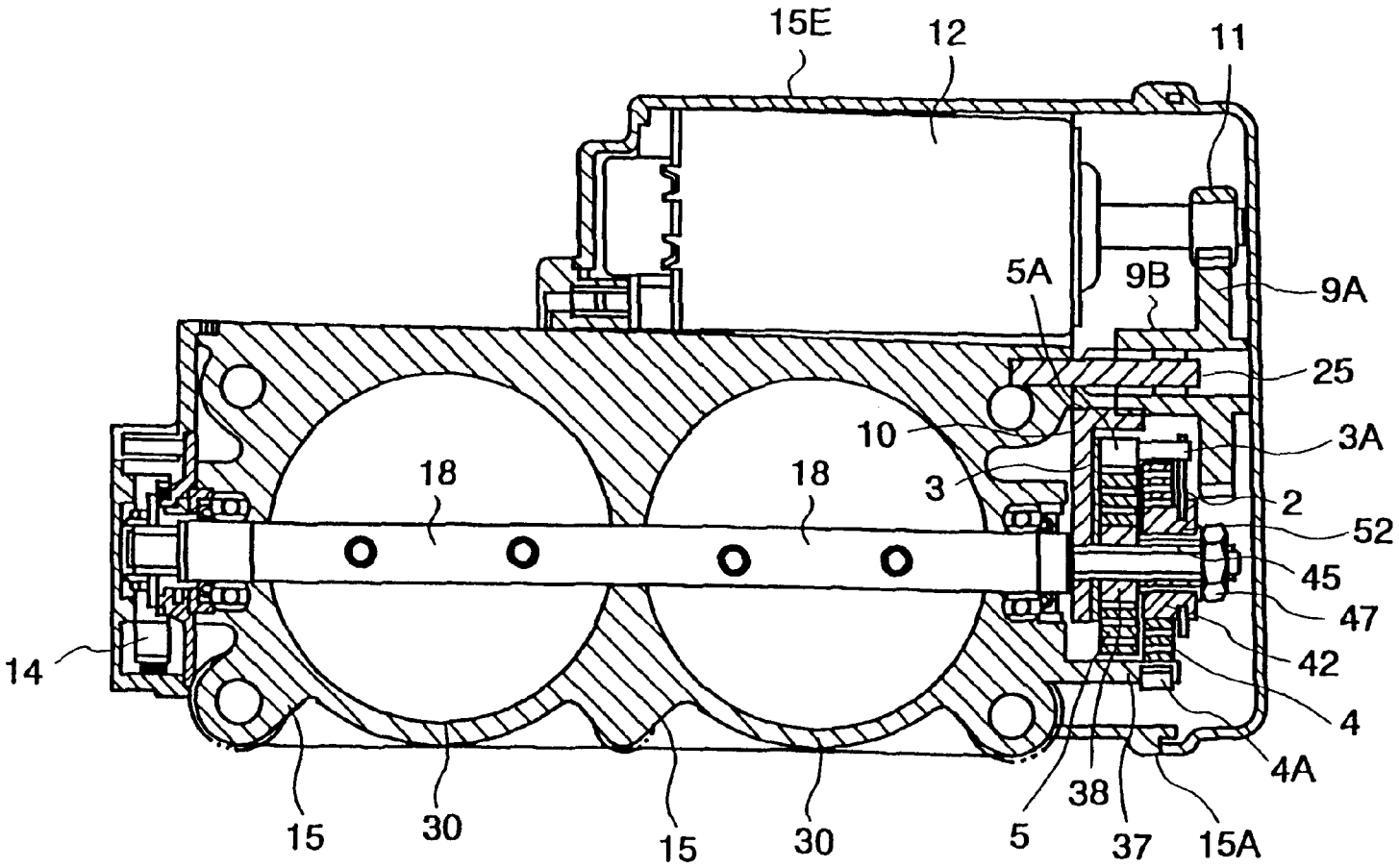
FIG. 20 is a sectional view showing a five embodiment.

FIG. 20 is a cross-sectional drawling of the fifth embodiment. This embodiment includes a type of apparatus excluding the limp home mechanism (full electronic control type), and the accelerator shaft, the accelerator lever and the accelerator sensor are located separately outside the throttle body. The accelerator mechanism is used for generating the signal regarding to the accelerator position and is separately installed in the neighborhood of the accelerator pedal not shown because the accelerator mechanism is not related to the open-close operation of the throttle valve.

The default opening mechanism is placed on one end of the throttle shaft 18 at the gear mechanism side of the throttle drive system also in this example. Both of the return spring 4 and the default opening spring 5 are constructed by using a spiral spring and are the same as those in the second embodiment.

On one end of the throttle shaft 18, the throttle gear 10 and the lever 3 is fixed at first, the chip 38 with the default opening spring 5 is fixed next, and then the return spring 4 and the sleeve 42 with the sleeve 2 are engaged through the sleeve 45, and finally, those components are fastened by the nut 47. The sleeve 42 can rotate on the sleeve 45.

One end 4A of the return spring 4 is coupled with the pin 37 at the side of the throttle body 15 and the other end is coupled with the sleeve 42.

The arm portion 3A of the lever 3 extends over the default opening spring 5 and the return spring and can be coupled with the lever 2.

One end 5A of the default opening spring 5 is coupled with the arm portion 3A of the lever 3, and the other end is couple with the chip 38. In this example, the default opening adjusting screw 6 and the full-close position adjusting screw 7 not shown are placed in the case part 15 assembled in a single body with the throttle body 15. As the principle of the default opening operation in this embodiment is the same as that in the previous embodiment, its detail is not described here.

In this embodiment, the effects other than the effect brought by the limp home operation are the same as those obtained in the previous embodiments, and the following effect can be obtained in addition to the effect I in the fourth embodiment.

j. The shaft torque T1 of the throttle shaft (that is to say "P1 characteristics") and T2 (that is to say "P2 characteristics") at the position of the stopper for setting the default opening are defined as below.

[Formula 2]

$$T1 \geqq Mf \times G + Vf$$

$$T2 \geqq Mf \times G + Vf$$

As the throttle shaft torque T1 and T2 can be reduced to be as small as possible and the difference between the throttle torque, T1−(−T2), near the throttle default opening position can be made small, the stabilization of throttle drive control can be established. In case that T2<Mf×G+Vf, although T2 of the second energizing means is sacrificed a little and a setting error occurs in the throttle default opening position as shown in FIG. 16, the initial purpose of the throttle opening setting can be achieved if the necessary amount of air flow required by the vehicle can be obtained for the combustion in the cold start-up.

k. In this example, across the throttle body 15, the reduction gear mechanism and the default opening setting mechanism is placed at one side and the throttle position sensor 14 is placed at the other side.

According to the above described structure, the gear mechanism and the throttle position sensor 14 are separated by two bores formed on the throttle body 15. Although abrasion particles are generally generated at the mechanical friction part (for example, intermetallic friction) of the gear mechanism, it will be appreciated by the above described separation layout structure that the insertion of abrasion particles into the throttle position sensor 14 is protected and that the performance degradation of the throttle position sensor can be prevented.

In addition, by means that the gear mechanism and the throttle default opening setting mechanism are put together in the casing 15A at the motor side, the integration of components can be established and the down-sizing of the throttle apparatus itself can be achieved. As the throttle position sensor 14 can be placed to be as close as possible to the center of the throttle body, the influence of vibration and bend of the throttle shaft can be disappeared and the change in the output characteristic can be reduced.

In FIG. 8, the throttle body is placed in the vertical direction on the engine block located behind the page space so that the motor terminal 12A of the motor may be located above the shaft 18. With this configuration, there never happens such a problem that abrasion particles generated from the brush are deposited on the terminals and the terminals may short. Therefore, if the mounting position of the throttle body is altered, the relative position between the motor and the throttle body should be modified so that the terminals of the motor may be located in the vertical direction.

Figure 22:
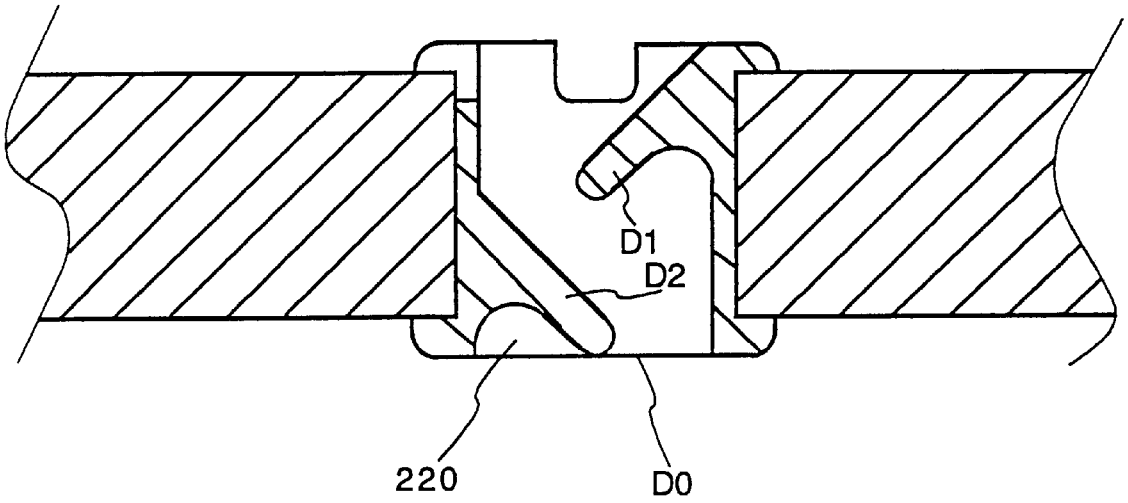
FIG. 22 is a view showing concretely the construction of the gas drainage (breathing hole) and a drain plug.

FIG. 22 shows the actual shape of the section of the gas drainage holes (the aspiration holes). A rubber-made drain plug D0 is inserted into each of the gas drainage holes. Raised portions D1 and D2 are formed in protrusion on an inner side to prevent water from invading from outside. These raised portions D1 and D2 are inclined toward the outside of the holes so that the inner water content can flow out easily.

What is claimed is:

1. An electronically controlled throttle apparatus for an internal combustion engine in which a throttle valve opened and closed by a motor is mounted in an intake air passage, wherein a gear mechanism for amplifying and transferring a torque of said motor is mounted at one end part of a rotating shaft of said throttle valve, and a spring mechanism composed of two types of springs operating in a close direction and an open direction of said shaft is mounted at the other end of said shaft, wherein a case covering an outline of said spring mechanism is integrally molded as a body formed with said intake air passage, and a limp home mechanism for opening and closing forcibly said throttle valve by operating an accelerator is mounted in said case.

2. An electronically controlled throttle apparatus for an internal combustion engine in which a throttle valve opened and closed by a motor is mounted in an intake air passage, wherein a gear mechanism for amplifying and transferring a torque of said motor is mounted at one end part of a rotating shaft of said throttle valve, and a spring mechanism composed of two types of springs operating in a close direction and an open direction of said shaft is mounted at the other end of said shaft, said two types of spring are composed of a couple of springs, wherein one of said two types of springs is formed as a throttle valve return spring (return spring) for energizing a rotating shaft of said throttle valve in a close direction, and the other of said two types of springs is formed as a default spring for rotating forcibly a rotating shaft of said throttle valve up to a designated opening position.

3. An electronically controlled throttle apparatus for an internal combustion engine in which a throttle valve opened and closed by a motor is mounted in an intake air passage, wherein a gear mechanism for amplifying and transferring a torque of said motor is mounted at one end part of a rotating shaft of said throttle valve, and a spring mechanism composed of two types of springs operating in a close direction and an open direction of said shaft is mounted at the other end of said shaft, wherein a throttle opening sensor for detecting a rotating position of said rotating shaft is mounted between said spring mechanism and a bearing of said rotating shaft.

4. An electronically controlled throttle apparatus for an internal combustion engine in which a throttle valve opened and closed by a motor is mounted in an intake air passage formed at a throttle body, which is configured so that a default stopper for determining a default opening of a throttle valve is mounted at a boss part molded integrally with said throttle body, said boss part is placed at a case part in which one end of a throttle shaft on which a throttle valve is mounted is extended, and a lever mounted on said throttle shaft is made contact with said default stopper at said default opening, a default screw (screw for determining a reference position of a throttle valve) is mounted inside a throttle apparatus itself.

5. An electronically controlled throttle apparatus for an internal combustion engine in which a throttle valve opened and closed by a motor is mounted in an intake air passage formed at a throttle body, wherein said motor is fixed by inserting a metallic plate between a motor mount bracket and said throttle body and screwing those components.

6. An electronically controlled throttle apparatus for an internal combustion engine in which a throttle valve opened and closed by a motor is mounted in an intake air passage, wherein a throttle position sensor for detecting an opening of a throttle and/or an accelerator position sensor for detecting a manipulated variable of an accelerator are composed of main and sub dual-system sensor couple, and an individual sensor has a main connector or a sub connector having terminals for power supply, output and GND at a ceiling position and has other connectors having terminals for power supply, output and GND at a floor position.

7. An electronically controlled throttle apparatus for an internal combustion engine in which a throttle valve opened and closed by a motor is mounted in an intake air passage formed at a throttle body and said motor is mounted at said throttle body, wherein a hot water passage for leading an engine cooling water is formed in said throttle body, and a rib for heat conduction is formed at a throttle body near said motor and/or said throttle valve, and heat can be transmitted to said heat water passage.

8. An electronically controlled throttle apparatus for an internal combustion engine in which a throttle valve opened and closed by a motor is mounted in an intake air passage formed at a throttle body, wherein a diameter of a sensor mounted in said apparatus for detecting an opening of said throttle valve is made to be almost equal to a height of said throttle apparatus.

* * * * *